US006905197B2

(12) United States Patent
Suenaga et al.

(10) Patent No.: US 6,905,197 B2
(45) Date of Patent: Jun. 14, 2005

(54) INK SUPPLY DEVICE, INK-JET RECORDING DEVICE, AND METHOD OF SUPPLYING INK

(75) Inventors: Koji Suenaga, Ebina (JP); Tatsuhiro Ishize, Ebina (JP); Mitsuhide Soga, Ebina (JP); Katsushi Amarume, Ebina (JP); Takaaki Sekiyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 43 days.

(21) Appl. No.: 10/395,590

(22) Filed: Mar. 24, 2003

(65) Prior Publication Data

US 2003/0142177 A1 Jul. 31, 2003

Related U.S. Application Data

(63) Continuation of application No. 09/981,218, filed on Oct. 16, 2001, now Pat. No. 6,612,689.

(30) Foreign Application Priority Data

Oct. 17, 2000 (JP) ..... 2000-316974

(51) Int. Cl.[7] ..... B41J 2/175

(52) U.S. Cl. ..... 347/85

(58) Field of Search ..... 347/7, 84, 85, 347/86, 87

(56) References Cited

U.S. PATENT DOCUMENTS 6,048,055 A * 4/2000 Hakkaku ..... 347/86
6,390,611 B1 * 5/2002 Kobayashi et al. ..... 347/84
6,520,630 B1 * 2/2003 Oda et al. ..... 347/85
6,612,689 B2 * 9/2003 Suenaga et al. ..... 347/85
6,726,313 B1 * 4/2004 Oda et al. ..... 347/85

* cited by examiner

*Primary Examiner*—Anh T. N. Vo
(74) *Attorney, Agent, or Firm*—Fildes & Outland, P.C.

(57) ABSTRACT

An ink supply device is provided in correspondence with a recording head unit. The recording head unit has a recording head that ejects ink drops onto a recording medium on the basis of image information. Additionally the recording head unit has a sub ink tank provided with an air communication hole. The ink supply device includes an ink supply unit that supplies ink to the sub ink tank by reducing pressure on the inside of the sub ink tank through a pressure reduction part. A sealing part at least implements sealing of the air communication hole while the ink supply unit is reducing the pressure inside the sub ink tank.

19 Claims, 20 Drawing Sheets

INK SUPPLY DEVICE, INK-JET RECORDING DEVICE, AND METHOD OF SUPPLYING INK

CROSS REFERENCE TO RELATED APPLICATION

This patent application is a continuation application of U.S. application Ser. No. 09/981,218, filed Oct. 16, 2001 now U.S. Pat. No. 6,612,689, entitled "INK SUPPLY DEVICE, INK-JET RECORDING DEVICE, AND METHOD OF SUPPLYING INK", herein incorporated by reference in its entirety.

BACKGROUND OF THE INVENTION

1. Field of the Invention

The present invention relates to an ink supply device that supplies ink into a sub ink tank of a recording head unit, an ink-jet recording device having the ink supply device, and a method of supplying ink.

2. Description of the Related Art

In the ink-jet recording device that ejects ink drops on a recording medium such as a paper from recording heads on the basis of image information and records the image, there is such a configuration that mounts the sub ink tanks corresponding to each of the recording heads on a carriage to make the recording heads scan, in which there are various types of proposals as to the supply of ink into the sub ink tanks.

For example, Japanese Published Unexamined Patent Application No. Hei 6-238911 discloses an ink-jet printer as shown in FIG. 18, in which an ink tank 314 is disposed on one end of the shifting range of a recording head 312. The ink tank 314 has an ink supply outlet 318 formed at a position corresponding to an ink supply inlet 316 of the recording head 312, and has a bellow portion 320 formed on the middle thereof. And, as the recording head 312 returns to the home position, the ink supply inlet 316 of the recording head 312 is connected with the ink supply outlet 318 of the ink tank 314, and the recording head 312 is pressed to the ink tank 314 by a drive force of a drive motor not illustrated; thus, the bellow portion 320 of the ink tank 314 shrinks by this pressing force. Accordingly, the content volume of the ink tank 314 varies, and the ink inside the ink tank 314 flows into a common liquid chamber by way of the ink supply outlet 318 and the ink supply inlet 316. The ink tank 314 that once shrank recovers the original volume by the recording head 312 shifting and releasing the pressure, and by a self-restoring force of the bellow portion 320. AT this moment, a check valve 322 provided with the ink tank 314 opens, and the air equivalent to the volume of ink supplied into the recording head 312 flows into the ink tank 314 from an air intake 324.

However, in the construction in which the supply of ink is carried out by such pressurization, the supply of ink can take a comparably long time in some cases, which sometime lowers the efficiency of the ink supply.

In contrast to this, as shown in FIG. 19 and FIG. 20, the Japanese Published Unexamined Patent Application No. Hei 11-240180 discloses an ink-jet recording device that includes a first tank 354 provided with a recording head 352 and a second tank 356 to supply ink into the first tank 354. A switching hole 362 on a partition wall 360 that separates an ink chamber 358 of the first tank 354 from the recording head 352 can be opened and closed by a check valve 364; and as a differential pressure is produced, the switching hole 362 is to open. Supply of ink into the ink chamber 358 needs to couple a suction hole 366 with a suction cap 368, and thereafter drive a supply pump 370, thus decompressing the first tank 354. Next, a rubber seal 372 is made to advance by driving a reversible motor, and a needle 374 projected on the first tank 354 is inserted into the rubber seal 372, whereby the first tank 354 is connected with the second tank 356. Since the first tank 354 is in decompression, the ink is supplied from the second tank 356 into the first tank 354 by way of a tube 376.

However, in this construction, since the first tank 354 is not made to communicate with the atmosphere, the check valve 364 is required in order to prevent an ink leakage or air suction through a nozzle 378, due to a variation of the inner pressure, thereby making the structure complicated.

SUMMARY OF THE INVENTION

The present invention has been made in view of the above circumstances, and provides an ink supply device that permits supply of ink securely with a simple construction into a sub ink tank having an air communication hole, a method of supplying ink, and an ink-jet recording device provided with the ink supply device.

According to one aspect of the invention, the ink supply device possesses an ink supply unit provided in correspondence with a recording head unit including a recording head that ejects ink drops onto a recording medium on the basis of image information, and a sub ink tank provided with an air communication hole, storing the ink supplied to the recording head, which implements ink supply by a pressure reduction part reducing a pressure inside the sub ink tank; and a sealing part that at least permits sealing of the air communication hole while the ink supply unit is reducing the pressure inside the sub ink tank.

According to this invention, the sub ink tank that the ink is supplied into is provided with the air communication hole. This air communication hole softens a surge pressure variation inside the sub ink tank, accompanied with ejection's of ink and/or environmental changes, and so forth, and prevents an unexpected ink leakage from the sub ink tank and a mixture of air (air suction from an ink discharging nozzle of the recording head, and creation of air bubbles inside the sub ink tank). Thus, the recording head maintains an optimum state for discharge of ink drops.

Also, since the ink supply device has the sealing part, at least the device is able to seal the air communication hole of the sub ink tank, while the ink supply unit is reducing the pressure inside the sub ink tank. In the sealing state, as the pressure reduction part reduces the pressure inside the sub ink tank, the air does not flow unexpectedly into the sub ink tank, and the ink flows securely into the sub ink tank, thus achieving a smooth ink supply.

In addition, the ink supply is carried out not by the pressurization but by the decompression inside the sub ink tank; and the ink supply can securely be carried out in a shorter time.

According to another aspect of the invention, the ink supply device further includes a displacement mechanism that displaces the ink supply unit in relation to the sub ink tank between a non-supply position where the ink is not supplied and a supply position where the ink is supplied, wherein the sealing part is provided with the ink supply unit, and it carries out sealing of the air communication hole, based on a displacement from the non-supply position to the supply position by the displacement mechanism.

That is, the ink supply unit is displaced by the displacement mechanism from the non-supply position to the supply position in relation to the sub ink tank. The ink supply unit is designed to supply ink into the sub ink tank at the supply position, where the ink is supplied into the sub ink tank.

As the ink supply unit displaces from the non-supply position to the supply position, by this displacement, the sealing part seals the air communication hole. In this manner, the utilization of the displacement of the ink supply unit simplifies the construction, and also secures the sealing of the air communication hole, interlocking with the ink supply operation into the sub ink tank.

Further, the sealing part is provided integrally with the ink supply unit.

Thereby, the ink supply device reduces the number of components, simplifies its construction to diminish the size, and reduces the manufacturing cost.

According to another aspect of the invention, the ink supply unit is provided with an air suction member and an ink supply member that are connected to the sub ink tank, and the sealing part is made to seal the air communication hole, after the air suction member and the ink supply member are connected to the sub ink tank.

Therefore, after the air suction member and the ink supply member are connected to the sub ink tank, the sealing part seals the air communication hole. In this state, as the air suction member sucks the air inside the sub ink tank, the ink flows into the sub ink tank from the ink supply member, resulting in supplying ink.

Now, in this series of operation, if the construction is such that the sealing part seals the air communication hole first, and then the air suction member and the ink supply member are connected to the sub ink tank, there will be apprehensions that a slight variation of pressure created during connection will not be absorbed, because the air communication hole is already sealed. In contract to this, in this invention, since the air suction member and the ink supply member are connected to the sub ink tank first, and then, the sealing part seals the air communication hole, a slight variation of pressure created during connection will be absorbed by the air communication hole that is not sealed.

According to another aspect of the invention, the ink supply member is provided with a valve mechanism.

This provision of the valve mechanism blocks up the ink supply member except during the ink supply, which precludes unexpected drying of ink, mixture of foreign matters into the ink, and so forth.

According to another aspect of the invention, a plural number of ink supply units are provided in correspondence with the plural recording head units, and the displacement mechanism displaces a specific one of the ink supply units and the sealing parts in relation to the corresponding specific one of the recording head units independently from the other ink supply units and sealing parts.

Since the plural ink supply units are provided in correspondence with the plural recording head units, for example, an ink-jet recording device capable of color image recording is able to supply ink into the sub ink tank of the recording head unit individually for each color.

According to another aspect of the invention, the pressure reduction part includes a suction pump.

The suction by the suction pump secures decompression inside the recording head unit in a short time.

According to another aspect of the invention, the inkjet recording device includes any one of the foregoing ink supply devices, and a recording head unit including a sub ink tank into which the ink supply device supplies ink, provided with an air communication hole, and a recording head that ejects the ink supplied from the sub ink tank onto a recording medium on the basis of image information as ink drops.

In this ink-jet recording device, the ink supplied from the ink supply device into the sub ink tank of the recording head unit is ejected as ink drops onto a recording medium by the recording head, thereby forming an image on the recording medium. The sub ink tank is provided with the air communication hole, which eases a pressure variation due to ejection of ink and environmental changes, and so forth. Thereby, an unexpected ink leakage from the sub ink tank and a mixture of air into the sub ink tank can be prevented, and the recording head maintains an optimum state for discharge of ink drops.

And, since this ink-jet recording device includes any one of the foregoing ink supply devices, it is able to seal the air communication hole of the sub ink tank while supplying ink. In the sealing state, the decompression inside the sub ink tank by the pressure reduction part will preclude an unexpected flow of air into the sub ink tank through the air communication hole; and accordingly, the ink securely flows into the sub ink tank. Thus, the ink is supplied by means of the decompression inside the sub ink tank, not by the pressurization, and a secure ink supply can be achieved in a shorter time.

According to another aspect of the invention, it is preferable that both a supplying connection portion to which the ink supply member is connected and a sucking connection portion to which the air suction member is connected, in the sub ink tank, include a valve mechanism.

Therefore, the valve mechanism is able to block up the supplying connection portion and the sucking connection portion, except while supplying ink into the sub ink tank, whereby unexpected evaporation of ink and leakage of ink and so forth can be prevented.

According to another aspect of the invention, the method of supplying ink into a sub ink tank provided with an air communication hole, in which the ink supplied to a recording head is stored includes a connection step of connecting an air suction member and an ink supply member to the sub ink tank, the air suction member capable of sucking air from the sub ink tank and the ink supply member capable of supplying the ink into the sub ink tank; a sealing step of sealing the air communication hole by a sealing part, after the connection step; and an suction step of sucking the air from the sub ink tank by the air suction member, after the sealing step.

That is, at the connection step, after the air suction member and the ink supply member are connected to the sub ink tank, at the sealing step, the sealing part seals the air communication hole. Therefore, if there is a slight variation of pressure created during connection, the variation of pressure will be absorbed by the air communication hole that is not sealed.

Thereafter, at the suction step, the air suction member sucks the air from the sub ink tank. Thereby, the ink flows into the sub ink tank through the ink supply member. Since the sealing part seals the air communication hole, the ink can be supplied securely into the sub ink tank in a shorter time.

In addition, the sub ink tank into which the ink is supplied has the air communication hole, which softens pressure variations inside the sub ink tank resulting from the discharges of ink and environmental changes and so forth. Thereby, an unexpected ink leakage from the sub ink tank and a mixture of air into the sub ink tank can be prevented, and the recording head maintains an optimum state for discharge of ink drops.

According to another aspect of the invention, the method of supplying ink further includes a sealing release step of releasing the sealing of the air communication hole by the sealing part, after the suction step; and a disconnection step of disconnecting the air suction member and the ink supply member from the sub ink tank, after the sealing release step.

Thus, after the ink supply is completed, first the sealing of the air communication hole is released at the sealing release step, and next at the disconnection step, the air suction member and the ink supply member are disconnected from the sub ink tank. Therefore, if there occurs a slight pressure variation during disconnection, this pressure variation will be absorbed, because the air communication hole is already opened (not sealed) at this moment.

BRIEF DESCRIPTION OF THE DRAWINGS

Preferred embodiments of the present invention will be described in detail based on the followings, wherein:

FIG. 15 illustrates a state that each of the ink supply units advances to the corresponding one of recording head units, in which

FIG. 16 illustrates a state that each of the ink supply units advances to the corresponding one of recording head units, in which

DETAILED DESCRIPTION OF THE PREFERRED EMBODIMENTS

Figure 1:
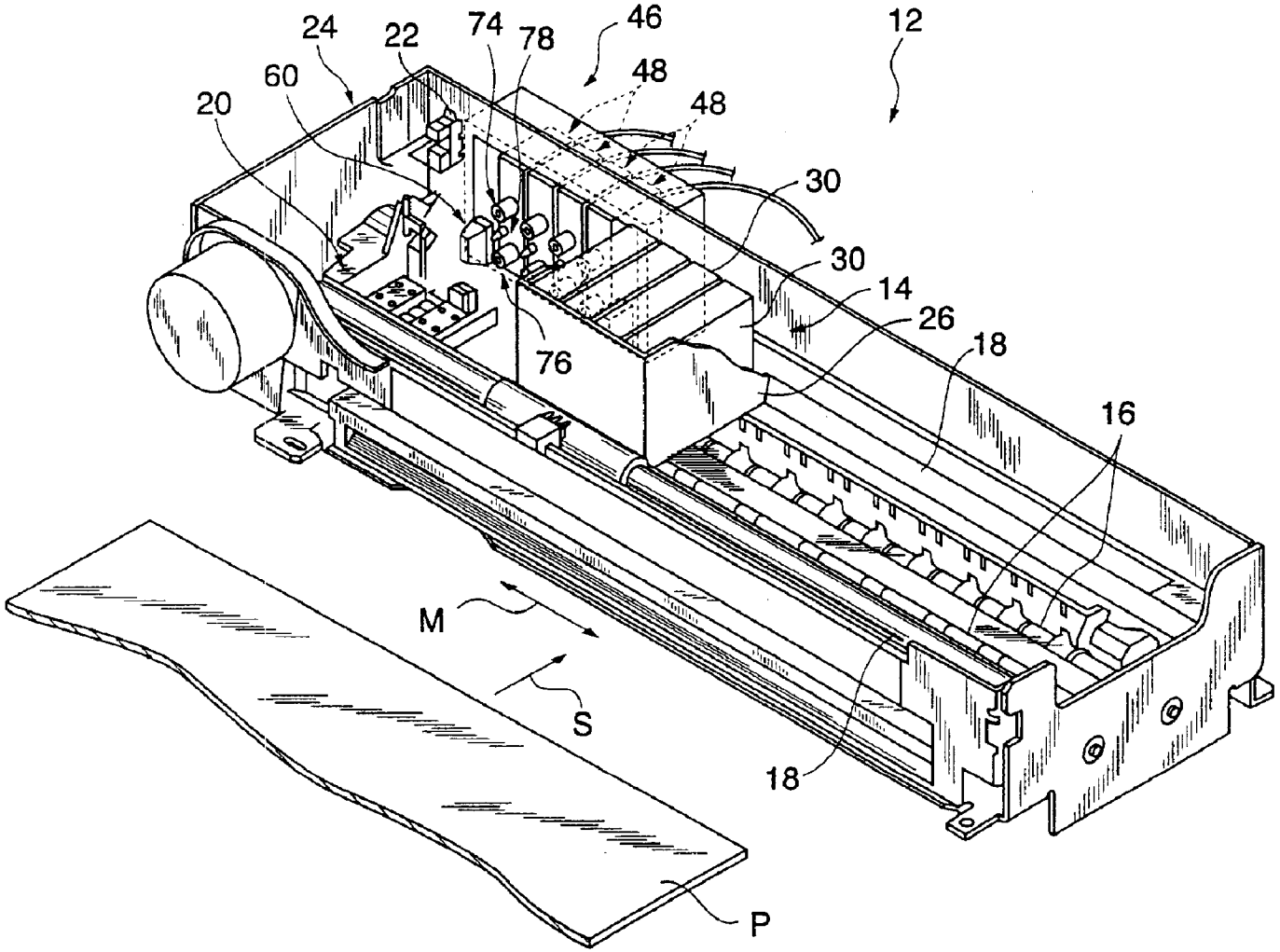
FIG. 1 is a perspective view illustrating a recording head carriage and its neighboring area of an ink-jet recording device provided with an ink supply device relating to one embodiment of the invention.

FIG. 1 illustrates an ink-jet recording device 12 of the first embodiment of this invention, in which a recording head carriage 14 and its neighboring area are enlarged.

The ink-jet recording device 12 includes a recording medium conveyance member 16 that conveys a recording medium P (for example, paper) in a fixed direction, and a pair of guide members 18 installed along a direction perpendicular to the conveyance direction of the recording medium P so as to face the conveyance route of the recording medium P. These guide members 18 support a recording head carriage 14. Further, a maintenance station 20 underlies the guide members 18 near the conveyance route of the recording medium P, which comes into contact and becomes disjoined with the recording head carriage 14 (moves up and down in this embodiment) to perform a maintenance operation of capping and suction of ink, etc. A control circuit not illustrated controls this maintenance operation in accordance with a specified condition and timing.

The home position of the recording head carriage 14 is set at a position facing the maintenance station 20, and a position sensor 22 locates this home position. A main housing 24 retains the recording head carriage 14, recording medium conveyance member 16, guide members 18, maintenance station 20, and position sensor 22. Picture information is sent to the recording head carriage 14 through signal lines formed on a flexible board.

Here, the drawing indicates the moving direction (fast-scanning direction) of the recording head carriage 14 with an arrow M, and the moving direction (slow-scanning direction) of the recording medium P with an arrow S.

As illustrated also in FIG. 2 through FIG. 4, the recording head carriage 14 is made up with a recording head carriage frame 26 installed movably along the guide members 18, plural recording heads 28 (four heads, in this embodiment) mounted to project below the bottom (side to face the conveyance route of the recording medium P) of the recording head carriage frame 26, of which ink discharge openings are formed on the bottom, and sub ink tanks 30 that supply ink to each of the recording heads 28 disposed detachably on the recording head carriage frame 26. The number of the sub ink tanks 30 corresponds to that of the recording heads 28, and this embodiment takes on four tanks. Therefore, if the sub ink tanks 30 each supply the recording heads 28 each with different colored inks (black Bk, yellow Y, magenta M, cyan C) and discharge ink drops, it will be possible to record a full-colored picture image. A recording head 28 and a sub ink tank 30 in correspondence constitute a recording head unit 32 relating to this invention. Hereunder, in distinguishing the recording heads 28, sub ink tanks 30, and ink supply units 48 described later in correspondence with each of the colors, Bk, Y, M, or C will be put on after the symbol.

And, as shown in FIG. 1, the ink-jet recording device 12 of this embodiment conveys the recording medium P by means of the recording medium conveyance member 16, while making a reciprocating movement of the recording head carriage 14, discharges ink drops in accordance with picture information, and records an image on the recording medium P.

Figure 3:
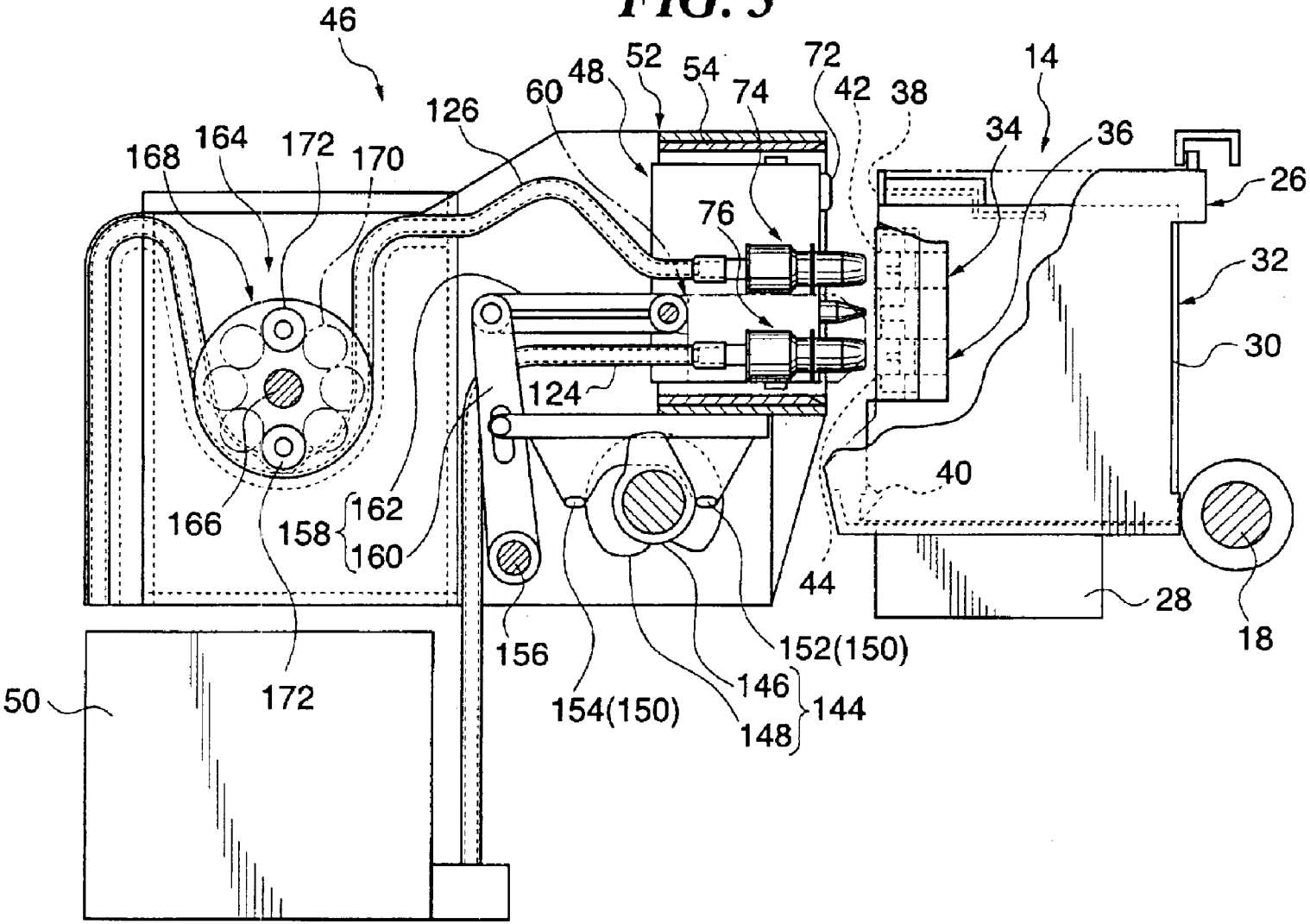
FIG. 3 is a partially broken-out side view illustrating a schematic construction of the ink supply device relating to the embodiment of the invention.

Each of the sub ink tanks 30 is, as shown in FIG. 3, provided with an exhaust port 34 having an air outlet 42 that permits a discharge of air inside the sub ink tank 30, and an ink supply port 36 below the exhaust port 34, having an ink supply inlet 44 that permits taking in ink into the sub ink tank 30. Further, the sub ink tank 30 has an air communication hole 38 formed above the exhaust port 34, through which air comes in and goes out of the sub ink tank 30. The going in and out of air through the air communication hole 38 eases a pressure variation inside the sub ink tank 30. Further, the sub ink tank 30 has an ink sensor 40 attached, which detects an ink quantity inside. The ink sensor 40 sends the detected information of the ink quantity inside the sub ink tank 30 to a control circuit not illustrated.

As shown in FIG. 1, the main housing 24 further retains an ink supply device 46 containing plural (four in this embodiment) ink supply units 48 in correspondence with each of the sub ink tanks 30. The position at which the ink supply unit 48 is to supply ink into the sub ink tank 30 is defined as the ink supply position of the sub ink tank 30. The ink supply position is also detected by the position sensor 22 in the same manner as the home position. The ink supply position may be set to the same position as the home position; however, in this embodiment, it takes a different position.

Figure 2:
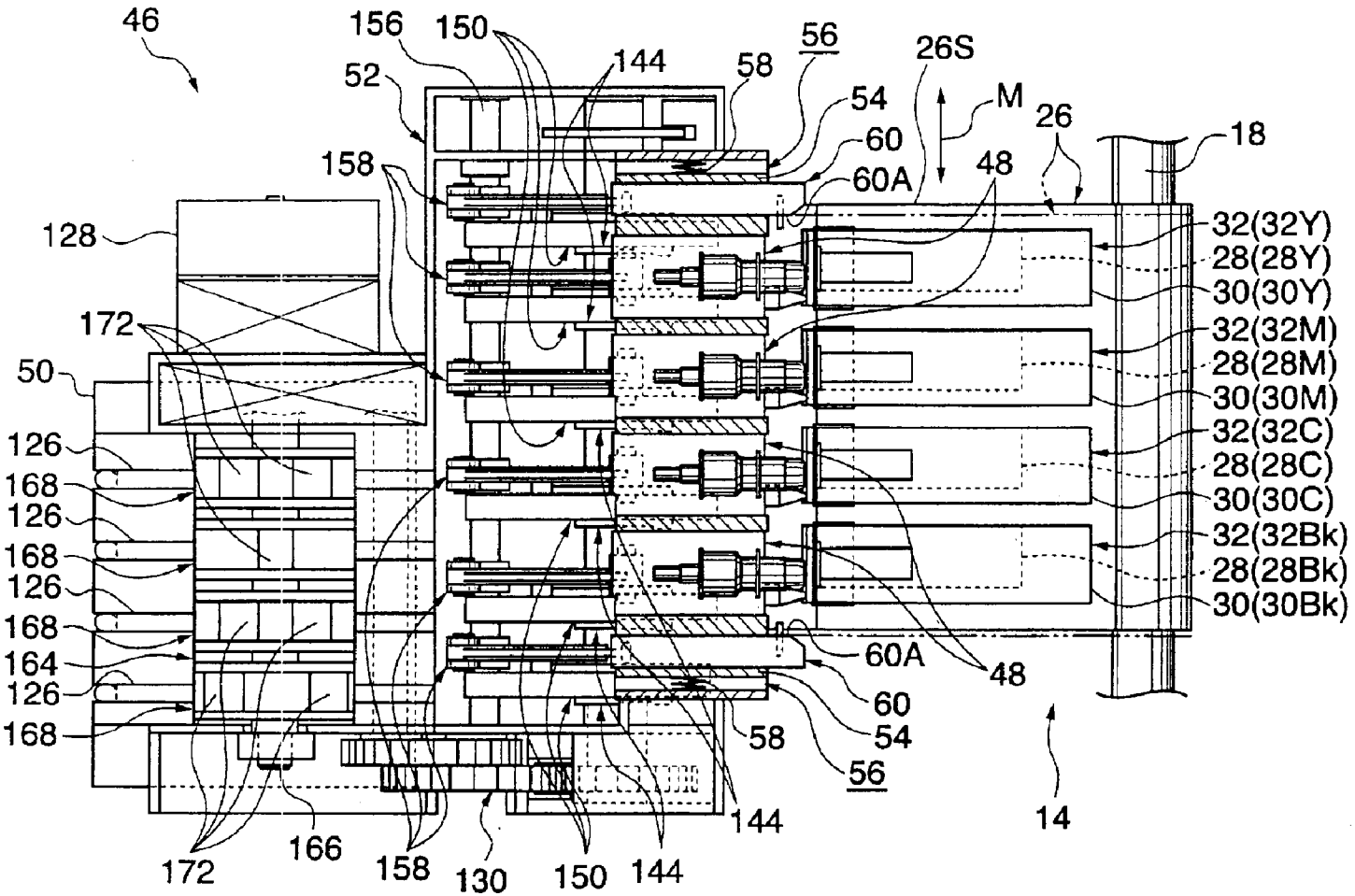
FIG. 2 is a plan view illustrating the ink supply device relating to the embodiment of the invention.

Further, as shown in FIG. 2 and FIG. 3, a main ink tank 50 underlies the ink supply device 46. The main ink tank 50 contains ink in advance that the ink-jet recording device 12 uses; and the ink supply device 46 supplies the ink into the sub ink tank 30, which is used for recording images. The main ink tank 50 is disposed to overlap partially with the ink supply device 46 when viewed from the top (in this embodiment, it overlaps substantially completely with the ink supply device 46), whereby the ink-jet recording device 12 achieves miniaturization as a whole.

Figure 4:
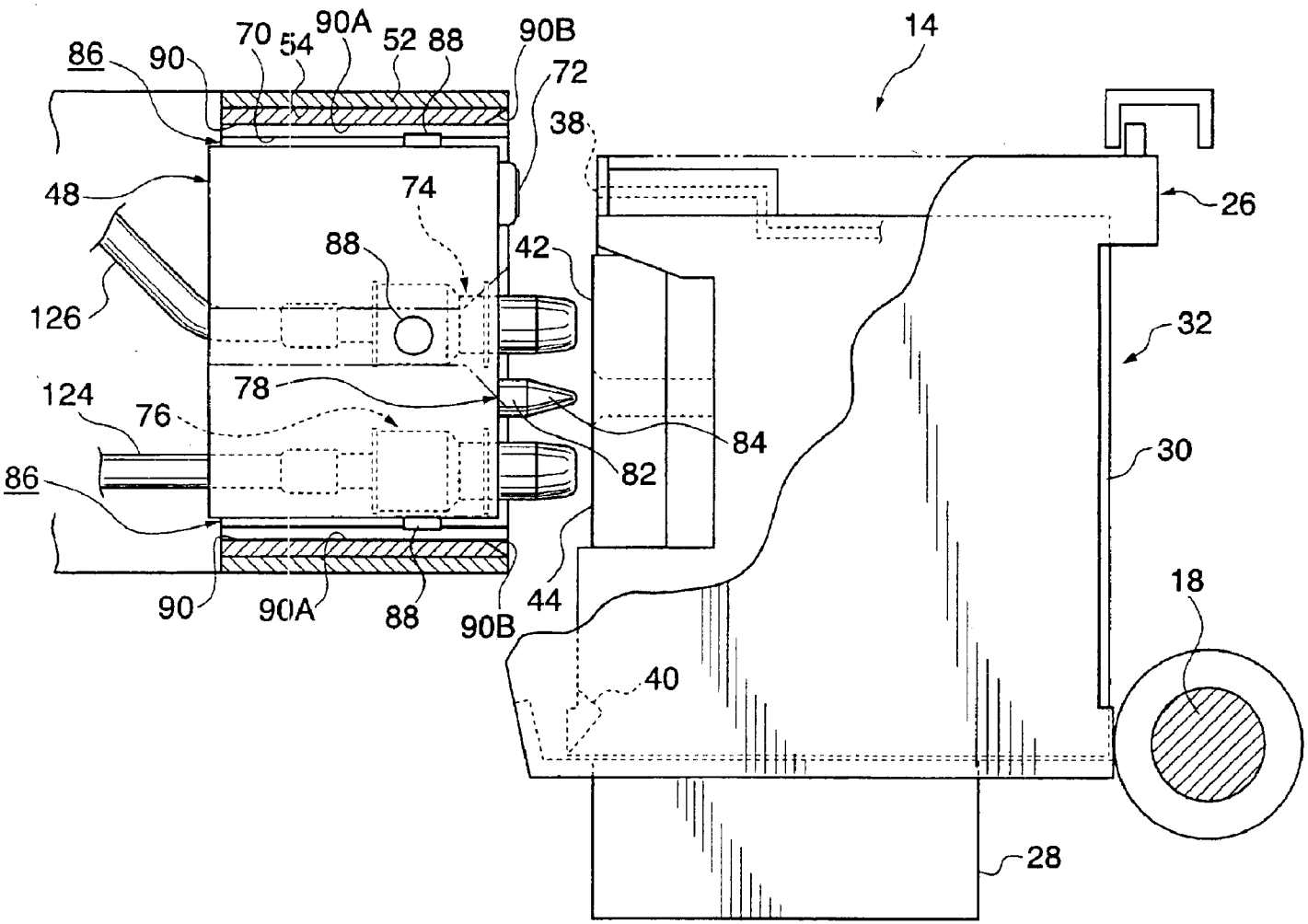
FIG. 4 is a partially broken-out side view enlarged, illustrating an ink supply unit of the ink supply device and a sub ink tank of the ink-jet recording device relating to the embodiment of the invention.
Figure 5:
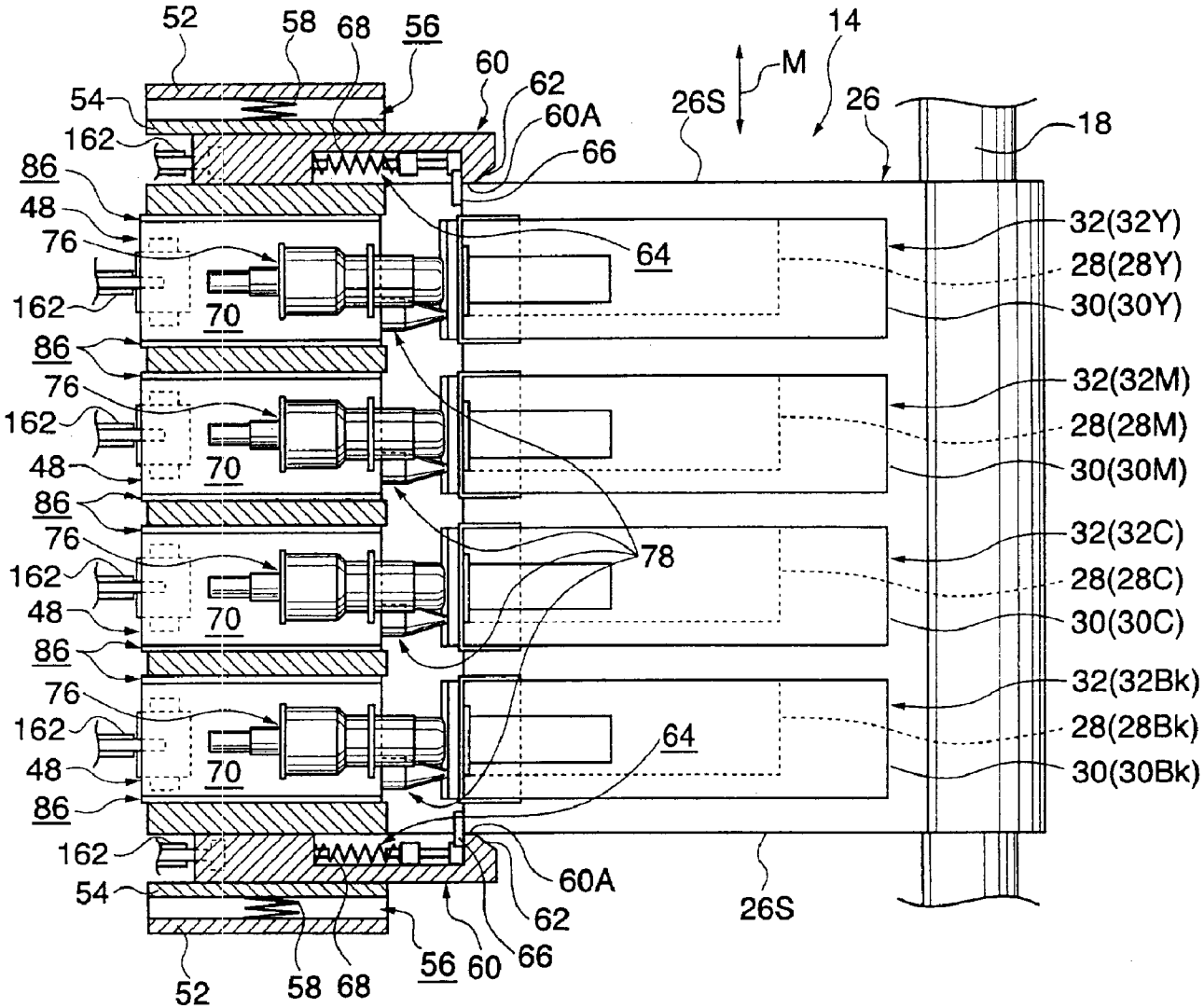
FIG. 5 is a partially broken-out plan view enlarged, illustrating an ink supply unit of the ink supply device and a sub ink tank of the ink-jet recording device relating to the embodiment of the invention.

As detailed in FIG. 4 and FIG. 5, the ink supply device 46 has a fixed frame 52 that is integrally mounted on the main housing 24 of the ink-jet recording device 12. Further, the fixed frame 52 has a guide frame 54 disposed therein. The guide frame 54 has specific gaps 56 in the cross direction between the fixed frame 52 and the guide frame 54. The guide frame 54 is movable in the fixed frame 52 within a certain range in the same direction as the moving direction (fast-scanning direction) of the recording head carriage 14. Further, the gaps 56 have compression coil springs 58 placed therein, which retain the guide frame 54 virtually in the center in the cross direction in the fixed frame 52. Here, the 'cross direction' as simply referred to signifies the same one as the cross direction of the guide frame 54, which coincides with the fast-scanning direction of the recording head carriage 14 (the direction indicated by the arrow M).

The guide frame 54 has a pair of positioning arms 60 installed near the both ends thereof, which can slide toward the recording head carriage 14. As shown in FIG. 2 and FIG. 3, in the normal state, the positioning arms 60 take a position where they will not come in contact with the recording head carriage 14. The space between inner sides 60A (opposing faces) of the positioning arms 60 is defined as equal to the breadth of the recording head carriage frame 26 of the recording head carriage 14.

As illustrated in FIG. 2 and FIG. 5, the positioning arms 60 have tapered faces 62 cut slant to the recording head carriage 14 formed on the end portions of the positioning arms 60 on the side of the recording head carriage 14. As illustrated by the solid line in FIG. 2, if the recording head carriage 14 is displaced in the cross direction to the guide frame 54 when it stops at the ink supply position (the chain double-dashed line in FIG. 2 shows the normal position of the recording head carriage frame 26), any one of the tapered faces 62 of the positioning arms 60 will come in contact with a corner of the recording head carriage frame 26 when the positioning arms 60 approach toward the recording head carriage 14. In this state, if the positioning arms 60 further approach toward the recording head carriage 14, the movement in this approaching direction will be converted into a cross-directional movement of the guide frame 54. Thereby, the guide frame 54 moves in the cross direction against an elastic force of the compression coil spring 58 (one of the gaps 56 between the fixed frame 52 and the guide frame 54 is expanded and the other one is narrowed). And, if the positioning arms 60 further approach toward the recording head carriage 14, as shown in FIG. 5, sides 26S of the recording head carriage frame 26 will come in contact with the inner sides 60A of the positioning arms 60, and the recording head carriage 14 and the guide frame 54 will be positioned correctly in the cross direction. Thereby, the four ink supply units 48 are to be integrally positioned to the corresponding sub ink tanks 30.

Figure 6:
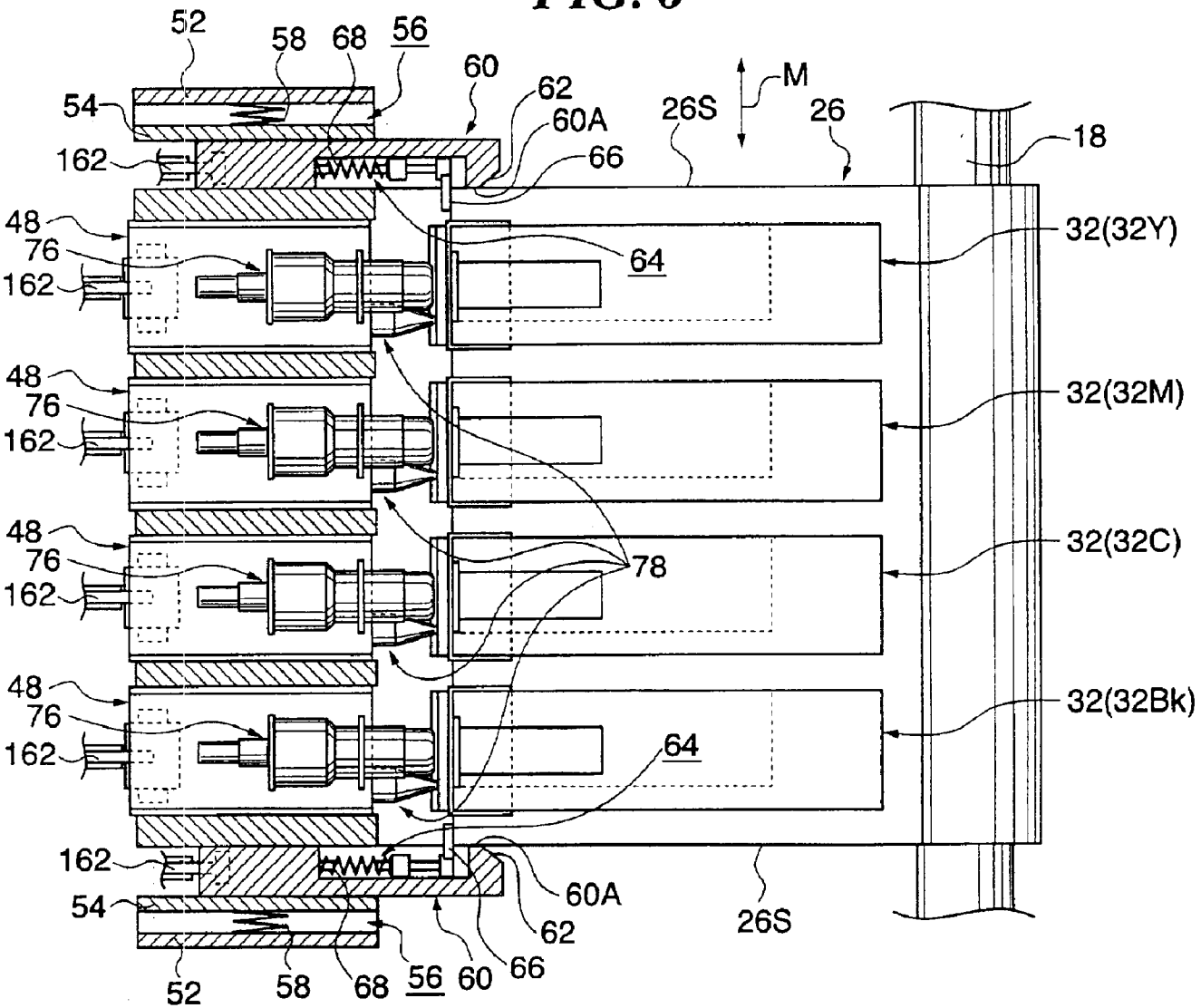
FIG. 6 is a partially broken-out plan view enlarged, illustrating an ink supply unit of the ink supply device and a sub ink tank of the ink-jet recording device with a positioning arm taking an advanced position, relating to the embodiment of the invention.

As illustrated in FIG. 5 and FIG. 6, the positioning arms 60 have pressing piece housings 64 inside thereof, and the pressing piece housings 64 contain pressing pieces 66 that project out partially from the inner sides 60A of the positioning arms 60. The pressing pieces 66 are made slidable in the pressing piece housings 64, and compression coil springs 68 energize the pressing pieces 66 in the direction approaching to the recording head carriage 14. In the state that the sides 26S of the recording head carriage frame 26 come in contact with the inner sides 60A of the positioning arms 60, and the recording head carriage 14 and the guide frame 54 are positioned correctly in the cross direction, and further, when the positioning arms 60 further advance toward the recording head carriage 14, then as shown in FIG. 6, the pressing pieces 66 receiving an energizing force by the compression coil springs 68 press the recording head carriage 14. Thereby, the recording head carriage 14 is held between the pressing pieces 66 and the guide members 18, which prevents looseness of the recording head carriage 14.

The guide frame 54 has the four ink supply units 48 corresponding to the four sub ink tanks 30 disposed therein. Each of the ink supply units 48 independently slides in each of containers 70, and approaches and comes off from the corresponding sub ink tank 30. The area of movement where the ink supply unit 48 approaches and comes off from the recording head carriage 14 (the sub ink tank 30) is designed not to overlap with the area of movement where the maintenance station 20 approaches and comes off from the recording head carriage 14, as understood from FIG. 1. Accordingly, when any one of the ink supply unit 48 and the maintenance station 20 approaches to and comes off from the recording head carriage 14, the other one does not have to draw back.

As shown in FIG. 3 and FIG. 4, each of the ink supply units 48 is provided on an opposing face to the corresponding sub ink tank 30 with an exhaust port 74 at a position corresponding to the air outlet 42 of the sub ink tank 30, and an ink supply port 76 at a position corresponding to the ink supply inlet 44 of the sub ink tank 30. When the ink supply unit 48 moves toward the corresponding sub ink tank 30, the exhaust port 74 is connected to the air outlet 42, and the ink supply port 76 is connected to the ink supply inlet 44.

Further, each of the ink supply units 48 has a cap 72 attached at a position corresponding to the air communication hole 38 of the sub ink tank 30. After the ink supply unit 48 approaches to the sub ink tank 30, and the exhaust port 74 and the ink supply port 76 are connected to the air outlet 42 and to the ink supply inlet 44, respectively, when the ink supply unit 48 further approaches the sub ink tank 30, the cap 72 seals the air communication hole 38, which deters a flow of air through the air communication hole 38 in the sub ink tank 30. The shape and the mounting position of the cap 72 are designed to fulfill the above function.

Further, each of the ink supply units 48 has a positioning pin 78 projected toward the sub ink tank 30. On the other hand, the sub ink tank 30 has a positioning port 80 formed at a position corresponding to the positioning pin 78. The positioning pin 78 is made up of a cylindrical positioning portion 82 having a constant diameter, and a conically formed guide portion 84 that is tapered toward the front from this positioning portion 82. The outer diameter of the positioning portion 82 is virtually equal to the inner diameter of the positioning port 80. As the ink supply unit 48 approaches the sub ink tank 30, first the guide portion 84 on the front side of the positioning pin 78 goes into the positioning port 80. Since the guide portion 84 is tapered toward the front, even if the center of the positioning pin 78 is dislocated from the center of the positioning port 80, the positioning pin 78 is driven to enter the positioning port 80. And, as the ink supply unit 48 further approaches the sub ink tank 30, the guide portion 84 drives the positioning pin 78 and the positioning port 80 to gradually move in such a direction that the centers of both coincide. When the positioning portion 82 reaches the positioning port 80, the center of the positioning pin 78 coincides with that of the positioning port 80, whereby the ink supply unit 48 and the sub ink tank 30 are positioned individually.

As shown in FIG. 3 through FIG. 5, there are specific gaps 86 formed between the upper, lower, right, and left sides of the ink supply unit 48 and the upper, lower, right, and left sides of the container 70 that contains the ink supply unit 48. The ink supply unit 48 has guide pins 88 projected from these sides, and the guide pins 88 are received in guide grooves 90 formed on these sides of the container 70.

As understood from FIG. 4, the guide groove 90 includes a retaining portion 90A whose outer diameter is formed slightly wider than that of the guide pin 88, and a divergent portion 90B that broadens toward the outside, formed on the end near the sub ink tank 30. The position of the divergent portion 90B is set such that the guide pin 88 stays in divergent portion 90B, in the state that the ink supply unit 48 approaches the sub ink tank 30 and the positioning pin 78 goes into the positioning port 80. Therefore, in the state that the positioning pin 78 does not enter the positioning port 80, the guide pin 88 moves inside the retaining portion 90A, and the ink supply unit 48 slides inside the container 70 without looseness. And, in the state that the positioning pin 78 enters the positioning port 80, the guide pin 88 reaches the divergent portion 90B, and a gap is formed between the guide pin 88 and the divergent portion 90B; and therefore, the ink supply unit 48 becomes movable within a certain range in the vertical and cross directions in the container 70. Therefore, in this state, namely, in the state that the positioning pin 78 goes into the positioning port 80, the guide of the ink supply unit 48 by the guide pin 88 and the guide groove 90 is substantially released, and the correct positioning by the positioning pin 78 and the positioning port 80 is accomplished. In addition, the gap between the guide pin 88 and the divergent portion 90B increases, as the guide pin 88 approaches to the sub ink tank 30; and the movable range of the ink supply unit 48 in the vertical and cross directions increases accordingly.

Figure 9:
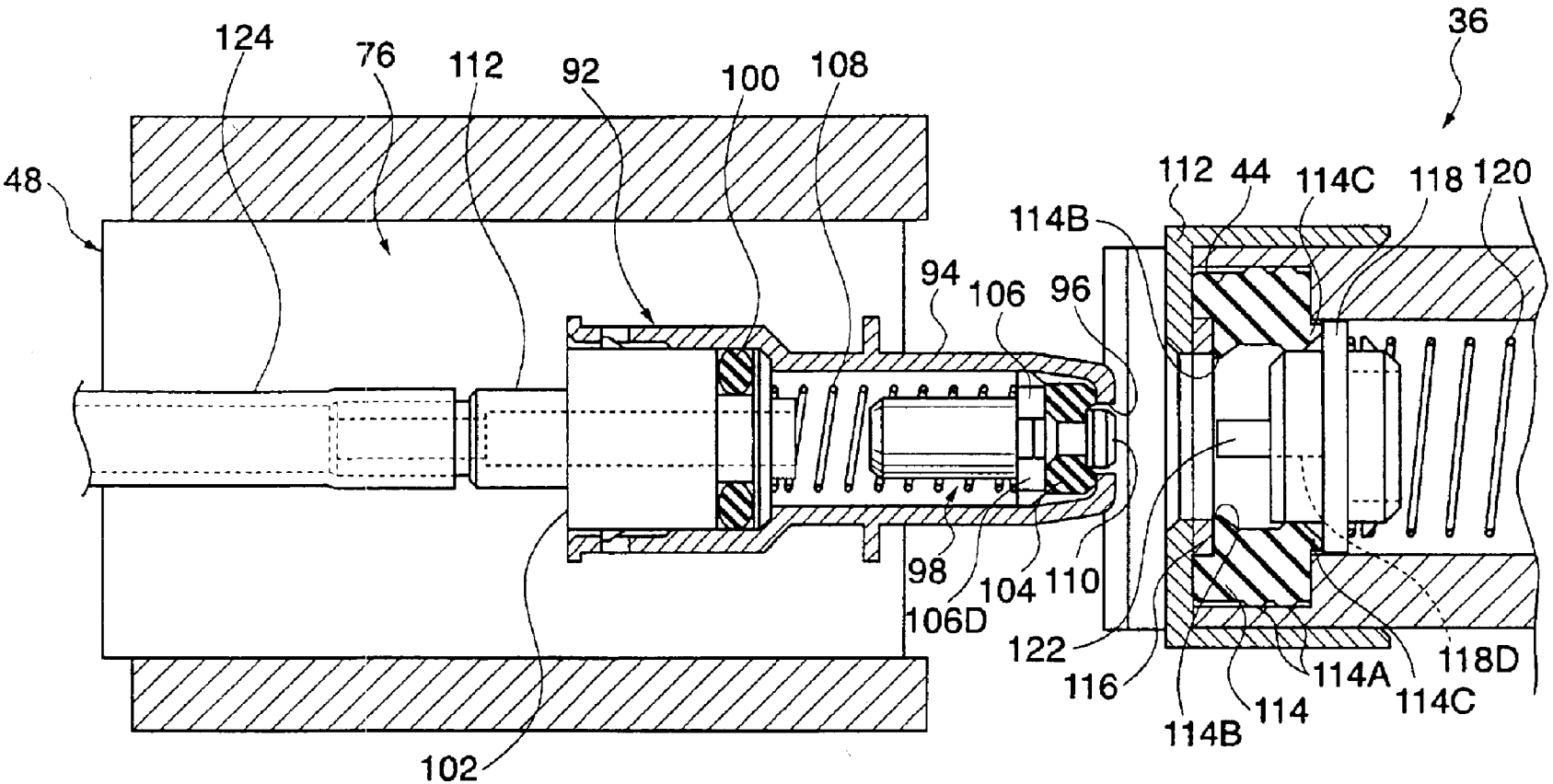
FIG. 9 is a sectional view illustrating a connection structure of an ink supply port of the ink supply device and an ink supply inlet of the sub ink tank relating to the embodiment of the invention.

Each of the ink supply ports 76 provided on each of the ink supply units 48 has an ink supply pipe 92 installed as shown in FIG. 9. The ink supply pipe 92 has a pipe body 94 that is formed in a substantially cylindrical shape as a whole. The pipe body 94 has a communication hole 96 formed on the front thereof, through which ink flows out into the sub ink tank 30. The front portion of the pipe body 94 has a tapered shape that the diameter gradually diminishes toward the front.

The pipe body 94 contains a valve element 98 that is movable in the longitudinal direction, and a bracket 102 that is press-fit in the rear end through an O-ring 100.

The valve element 98 includes a ring-shaped packing 104 made of an elastic member, a packing holder 106 that holds the packing 104 and is able to slide in the pipe body 94, and a compression coil spring 108 inserted between the packing holder 106 and the bracket 102, which energizes the packing holder 106 and the packing 104 toward the communication hole 96.

Figure 10A:
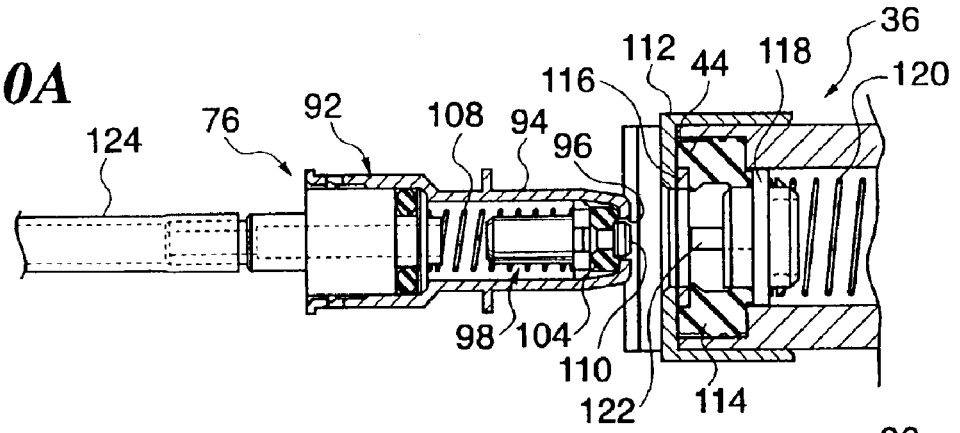
FIG. 10A through FIG. 10D are sectional views illustrating the process of connecting the ink supply port of the ink supply device to the ink supply inlet of the sub ink tank relating to the embodiment of the invention.
Figure 10B:
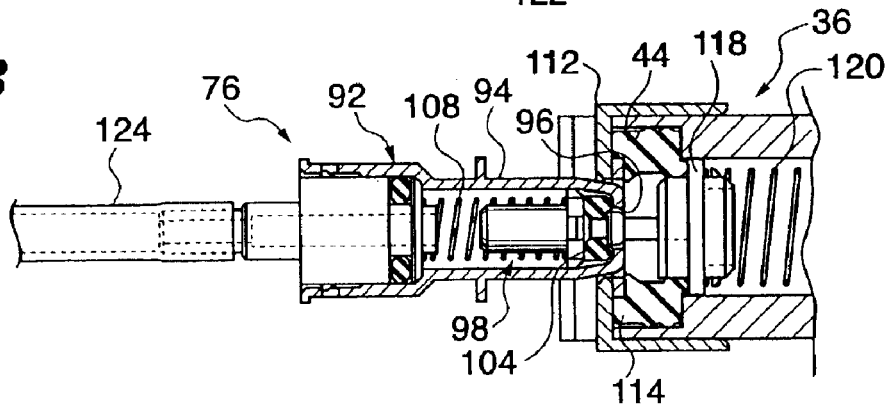
Figure 10C:
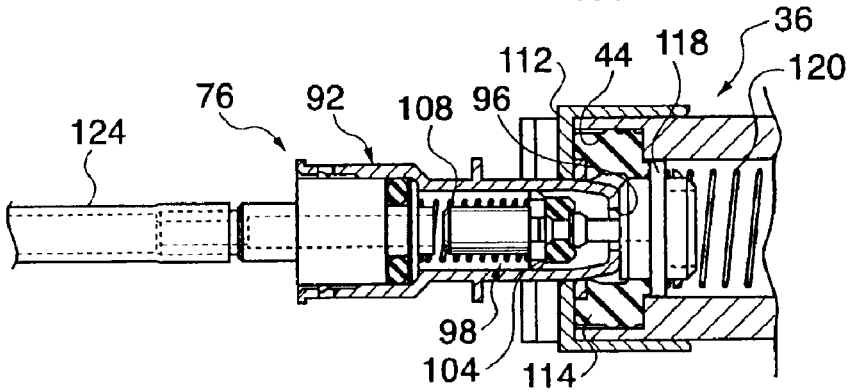
Figure 10D:
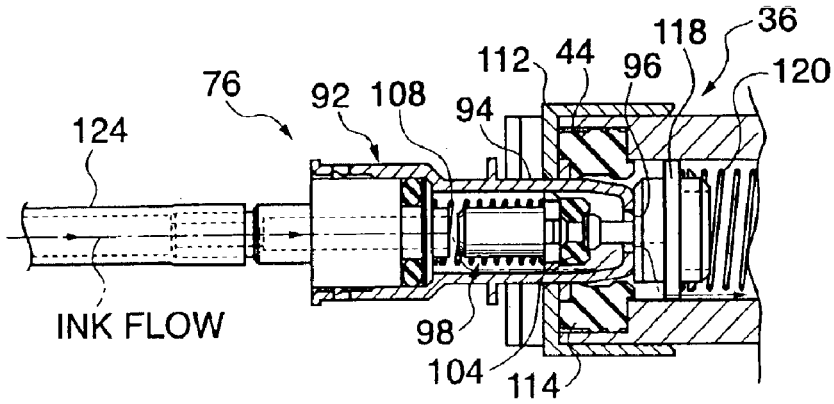

Normally, the compression coil spring 108 energizes the packing holder 106 and the packing 104 toward the communication hole 96, and presses the packing 104 onto the circumference of the communication hole 96 to thereby seal the communication hole 96; however, as shown in FIG. 10C and FIG. 10D, when the packing holder 106 and the packing 104 slide against an energizing force of the compression coil spring 108, and the packing 104 comes off from the circumference of the communication hole 96, the ink can be flowed through the communication hole 96.

The packing holder 106 has a valve contact 110 projected therefrom. The valve contact 110 pierces through the packing 104, and exposes the front end thereof to the outside through the communication hole 96; and a valve protrusion 122 described later is designed to press the front end.

The rear end of the bracket 102 is connected to one end of an ink supply tube 124 by way of a cover 112. As shown in FIG. 3, the other end of the ink supply tube 124 is connected to the main ink tank 50 that beforehand stores the ink used for image recording. As described later, when the ink supply port 76 is connected to the ink supply inlet 44 of the sub ink tank 30, a flow passage is made up from the main ink tank 50 to the sub ink tank 30.

On the other hand, the ink supply inlet 44 of the sub ink tank 30 has a gasket 114 placed inside thereof, which a gasket cover 112 retains at a specific position so as not to fall off. A circular swollen portion 114A is formed on the periphery of the gasket 114, and the swollen portion 114A is pressed on the inner face of the ink supply inlet 44, which deters a flow of ink and air through a gap between them. Further, the gasket 114 has a circular inward-projecting lip 114B formed thereon, and as shown in FIG. 10C and FIG. 10D, the lip 114B comes in contact with the outside of the inserted pipe body 94 over the whole circumference thereof, which blocks a flow of ink and air through a gap between them. An annular presser ring 116 is placed between the gasket cover 112 and the gasket 114, which restricts deformation of the lip 114B within a certain extent while drawing out and putting in the pipe body 94. This construction, when the pipe body is moved (drawn out and put in) in the ink supply inlet 44, prevents the lip 114B from following the drawing out and putting in unexpectedly only to perform as a resistor during that movement, and maintains adhesion of the lip 114B onto the circumference of the pipe body 94.

In the ink supply inlet 44, a valve 118 is placed further inside from the gasket 114. Normally, the valve 118 is energized by a compression coil spring 120 in the ink supply inlet 44, and is pressed onto a circular projection 114C formed on the gasket 114 to close a flow passage of ink. However, as shown in FIG. 10C and FIG. 10D, when the valve 118 slides against an energizing force of the compression coil spring 120 and comes off from the projection 114C, the flow passage of ink is formed. Here, in this embodiment, the spring constant of the compression coil spring 120 is set greater than that of the compression coil spring 108.

The valve 118 has the valve protrusion 122 projected therefrom, which faces to the valve contact 110 of the packing holder 106. As the pipe body 94 is inserted into the ink supply inlet 44, as shown in FIG. 10B, the front of the valve contact 110 comes in contact with the front of the valve protrusion 122 to press each other. This pressure slides the valve element 98 and the valve 118 to form the flow passage of ink. In this embodiment, the spring constant of the compression coil spring 120 is set greater than that of the compression coil spring 108, and the flow passage of ink is formed inside the pipe body 94 first, and then it is formed inside the ink supply inlet 44. Thereby, the ink supply unit 48 is liquidly coupled to the sub ink tank 30. Further, the packing holder 106 and the valve 118 both have communication holes 106D and 118D formed, which avoids blocking a flow of ink during liquid coupling.

The positions and shapes of the valve contact 110 and the valve protrusion 122 are speculated as specific ones to form a flow passage of ink after the insertion of the pipe body 94 into the ink supply inlet 44 and at least after the adhesion of the lip 114B onto the circumference of the pipe body 94.

Figure 11:
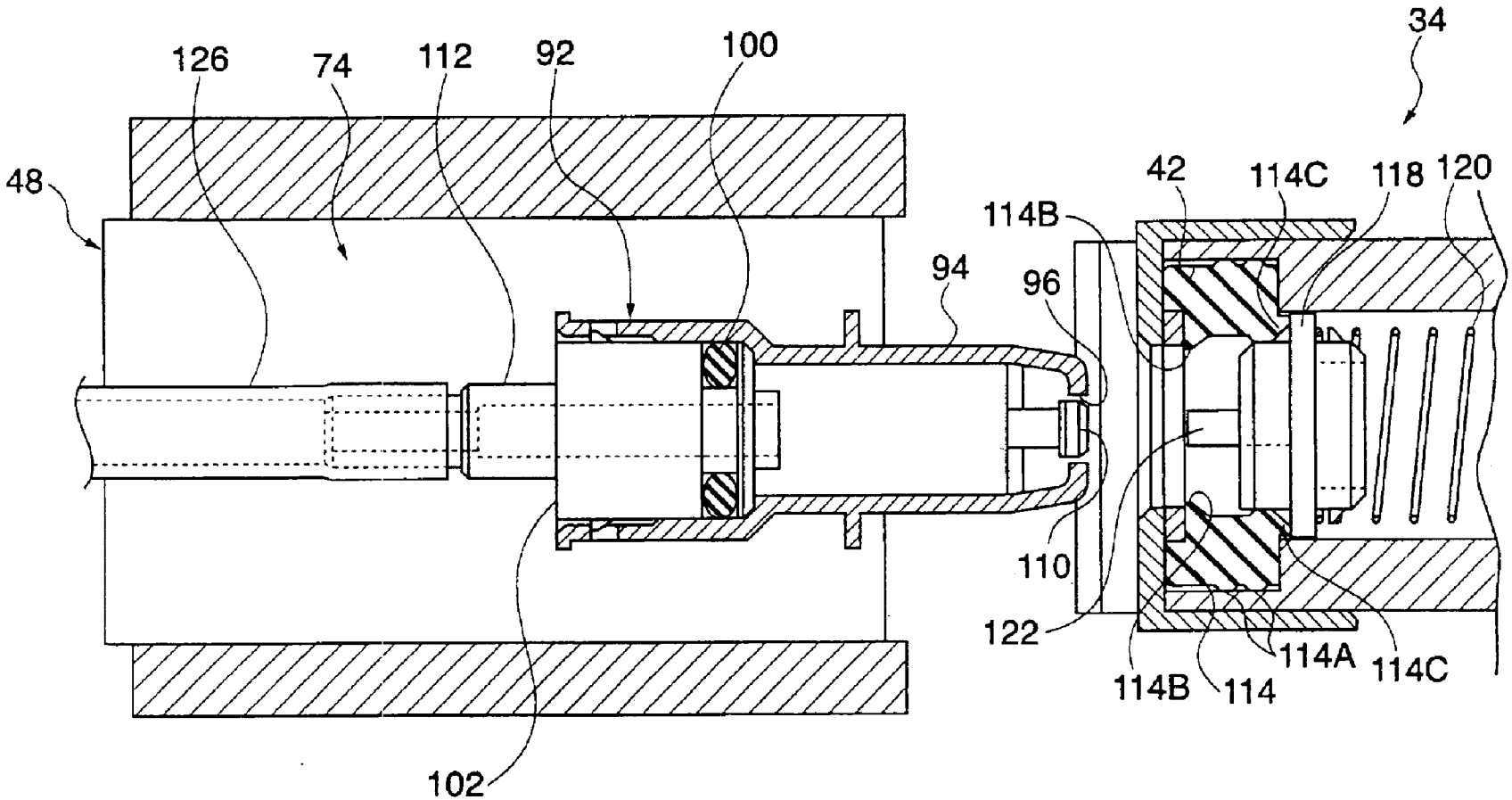
FIG. 11 is a sectional view illustrating a connection structure of an exhaust port of the ink supply device and an air outlet of the sub ink tank relating to the embodiment of the invention.

FIG. 11 illustrates the exhaust port 74 and the air outlet 42. The exhaust port 74 and the air outlet 42 are to discharge air inside the sub ink tank 30, as described later, inside of which ink does not flow. Accordingly, the exhaust port 74 does not contain the valve element 98 inside the pipe body 94. That is, the communication hole 96 of the pipe body 94 is always open, and the pipe body 94 is provided with the valve contact 110 that can press the valve protrusion 122. Such a construction also allows forming of a flow passage of air and discharging air inside the sub ink tank 30 from an exhaust tube 126, since the insertion of the pipe body 94 into the air outlet 42 causes the valve contact 110 to press the valve protrusion 122 to push in the gasket 114. Here, since the constructions of the exhaust port 74 and the air outlet 42 are stipulated as the same, except the aforementioned, as those of the ink supply port 76 and the ink supply inlet 44 illustrated in FIG. 9, the same components and members as those in FIG. 11 are given the same numeric symbols, and the descriptions will be omitted.

Figure 12:
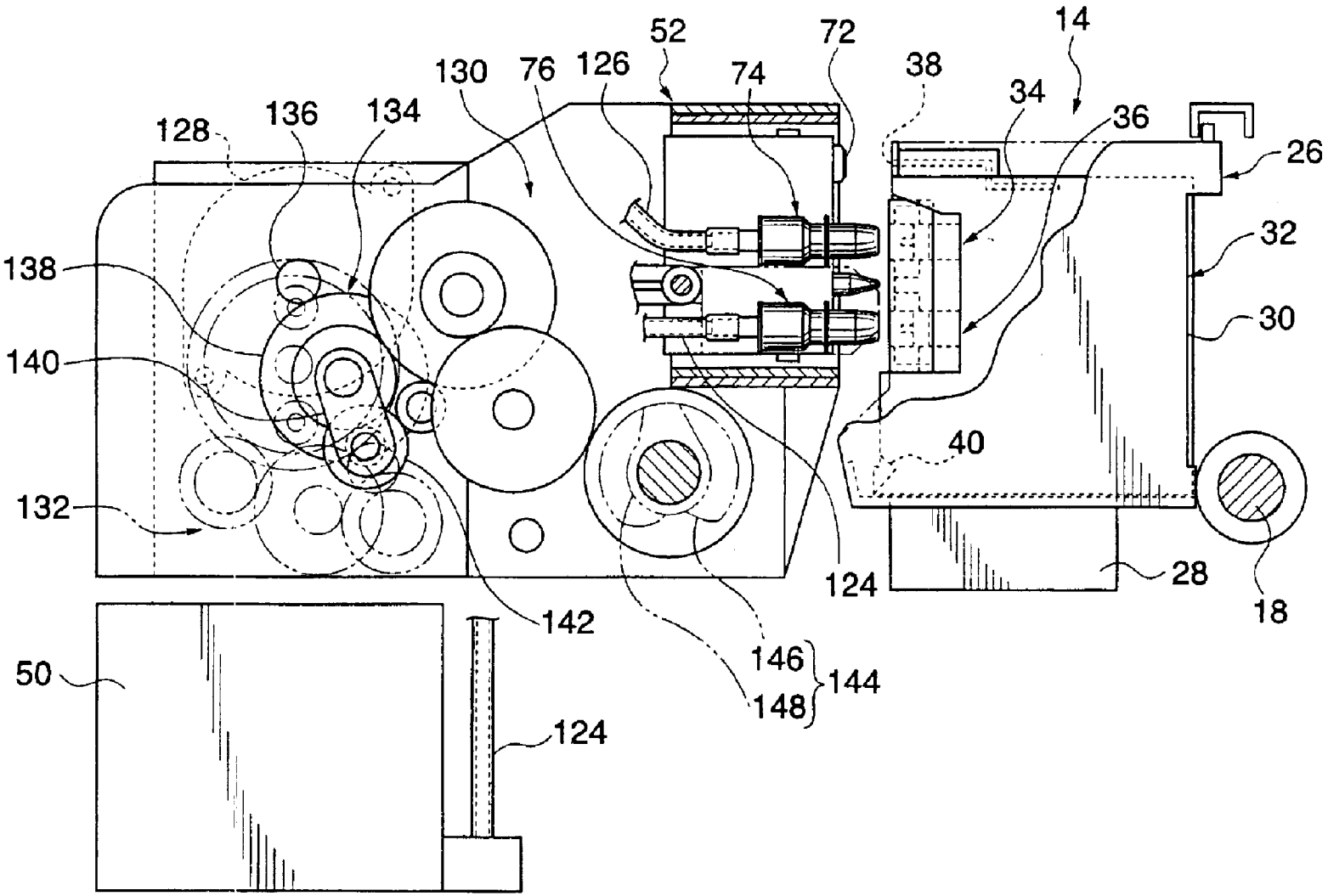
FIG. 12 is a partially broken-out plan view illustrating a drive system that displaces the ink supply unit in the ink supply device relating to the embodiment of the invention.
Figure 13:
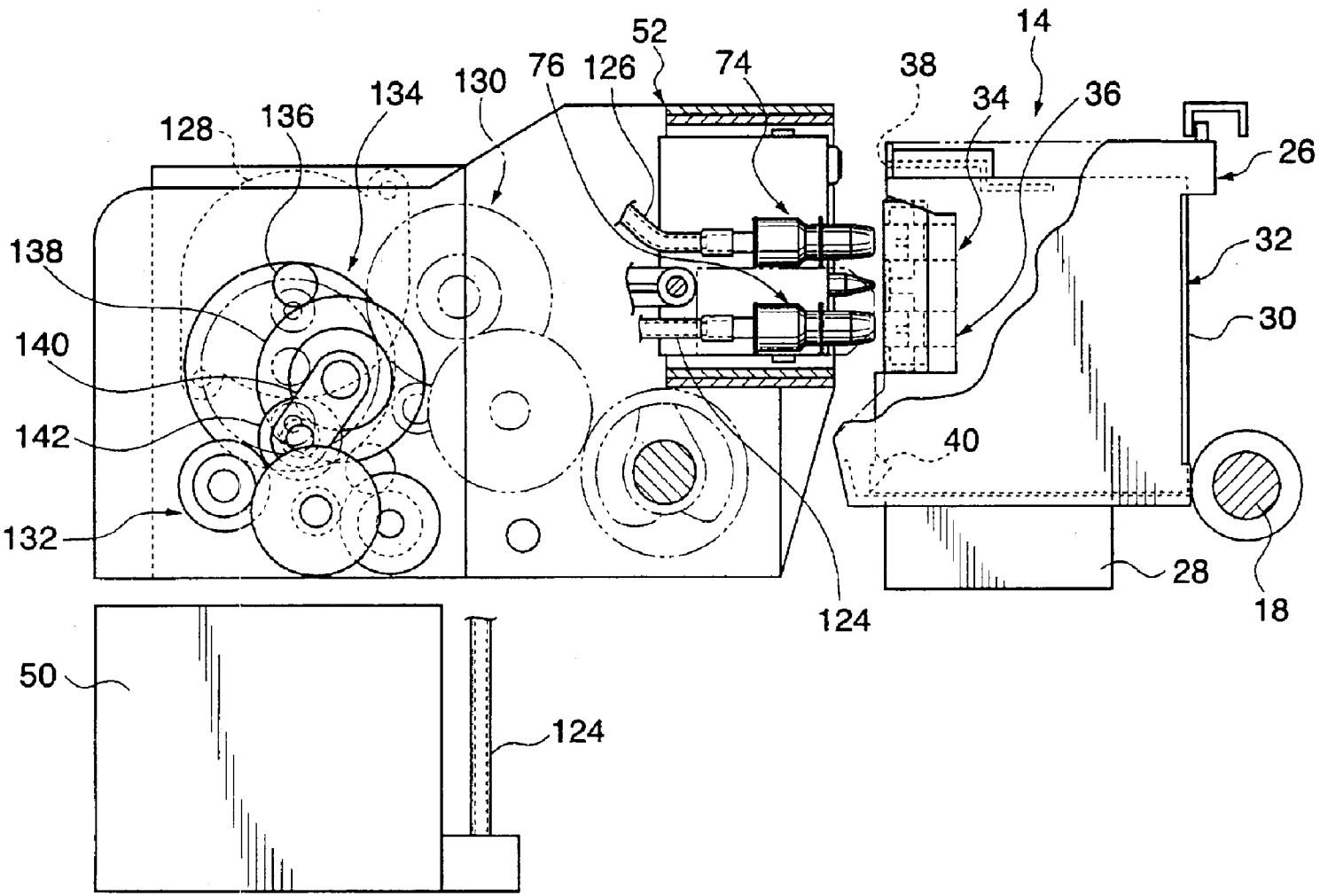
FIG. 13 is a partially broken-out plan view illustrating a drive system that drives a pump unit in the ink supply device relating to the embodiment of the invention.

As shown in FIG. 2, FIG. 12, and FIG. 13, on the fixed frame 52 are mounted a drive motor 128 that drives the ink supply device 46, an ink supply unit shifting gear train 130 that receives a drive force by the drive motor 128 to rotate, a pump driving gear train 132, and a clutch unit 134 that switches transmission of a rotating force according to the forward rotation and the reverse rotation of the drive motor 128 into the ink supply unit shifting gear train 130 or the pump driving gear train 132.

The clutch unit 134 includes an input-side gear 138 that engages with a drive gear 136 of the drive motor 128, a swing arm 140 placed swingably about the shaft of the input-side gear 138, and an output-side gear 142 attached on one front of the swing arm 140, which engages with the input-side gear 138 to receive a rotating force. As the drive motor 128 makes the forward rotation, as shown in FIG. 12, the swing arm 140 swings counterclockwise, and the output-side gear 142 engages with the ink supply unit shifting gear train 130. On the other hand, as the drive motor 128 makes the reverse rotation, as shown in FIG. 13, the swing arm 140 swings clockwise, and the output-side gear 142 engages with the pump driving gear train 132.

As understood from FIG. 2, FIG. 3, and FIG. 12, on the fixed frame 52 are laid out cam units 144 in correspondence with each of the ink supply units 48 and the positioning arms 60 (six in total, in this embodiment), so as to rotate coaxially integrally by a rotating force transmitted by the ink supply unit shifting gear train 130. Each of the cam units 144 is made up of a forward cam 146 that advances the corresponding ink supply unit 48 and positioning arm 60, and a backward cam 148 that retreats them.

Further, cam follower units 150 are laid out on the fixed frame 52. Each of the cam follower units 150 is provided integrally with a forward cam follower 152 and a backward cam follower 154 each corresponding to the forward cam 146 and the backward cam 148, and is able to slide in the same direction as the slide direction of the ink supply unit 48.

Further, the fixed frame 52 is provided with link mechanisms 158, each of which is made up of a link 160 capable of swinging about a spindle 156, and a shifting arm 162 whose one end is pivoted on the front of this link 160. The other end of the shifting arm 162 is pivoted on the positioning arm 60 or the ink supply unit 48. Further, the cam follower unit 150 is pivoted on substantially the center of the link 160. Thereby, as the cam follower unit 150 slides, the link mechanism 158 amplifies the slide, and the result is transmitted to the positioning arm 60 or the ink supply unit 48.

Each of the cam units 144 has predetermined positions and shapes of the forward cam 146 and the backward cam 148, so as to advance or retreat the corresponding positioning arm 60 or ink supply unit 48 at a specific timing. Further, the fixed frame 52 has a sensor attached thereon to detect a rotating position of the cam unit 144, which is not illustrated. On the basis of the rotating angle of the cam unit 144 that is detected by this sensor, a control circuit not illustrated drives the drive motor 128, sets the initial position of the cam unit 144, and controls the rotating angle thereof.

Figure 14:
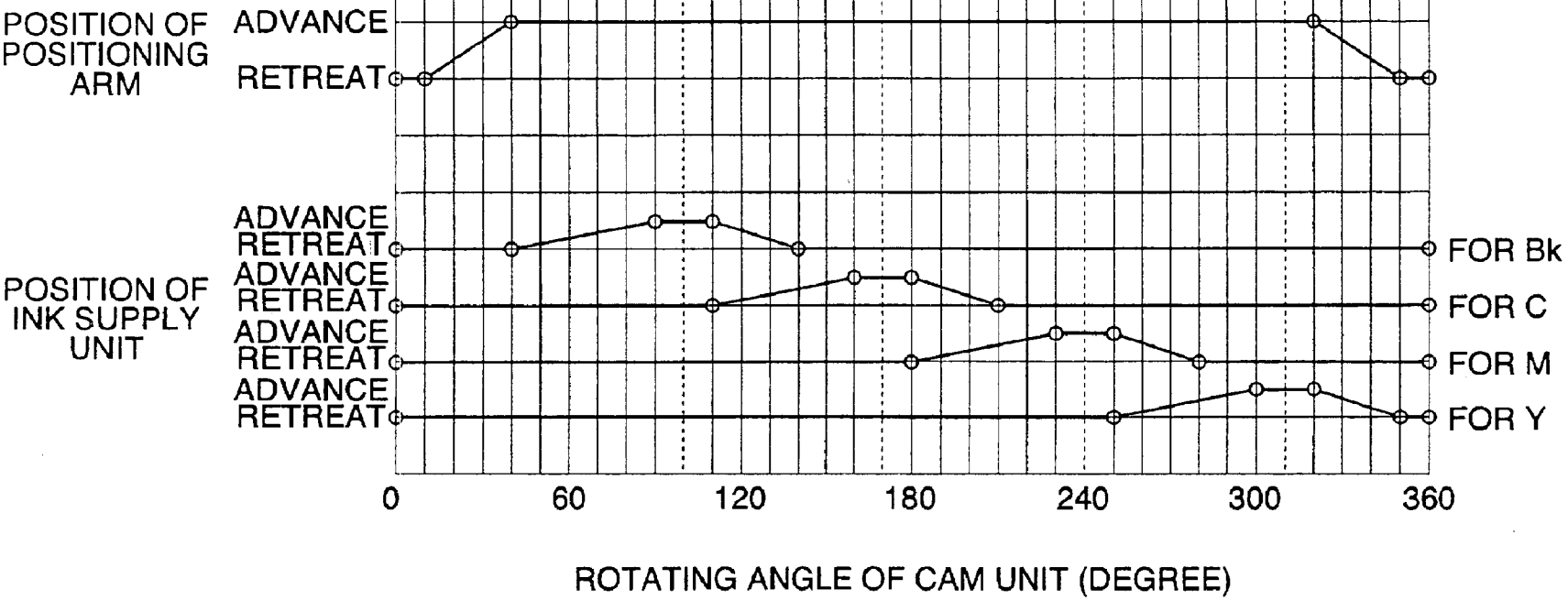
FIG. 14 is a graph illustrating a relation between a rotating angle of a cam unit and a position of the positioning arm, and a relation between the rotating angle and a position of the ink supply unit, in the ink supply device relating to the embodiment of the invention.

Therefore, as shown in FIG. 14, as the cam unit 144 turns, receiving a rotating force by the forward rotation of the drive motor 128, first, at the moment the rotating angle of the cam unit 144 reaches 10°, the forward cam 146 of the cam unit 144 corresponding to the positioning arm 60 advances the positioning arm 60 (refer to FIG. 5). As the rotating angle of the cam unit 144 reaches 40°, as shown in FIG. 6, the positioning arm 60 takes the most advanced position; and until the rotating angle reaches 320°, the positioning arm 60 maintains this position.

Figure 15B:
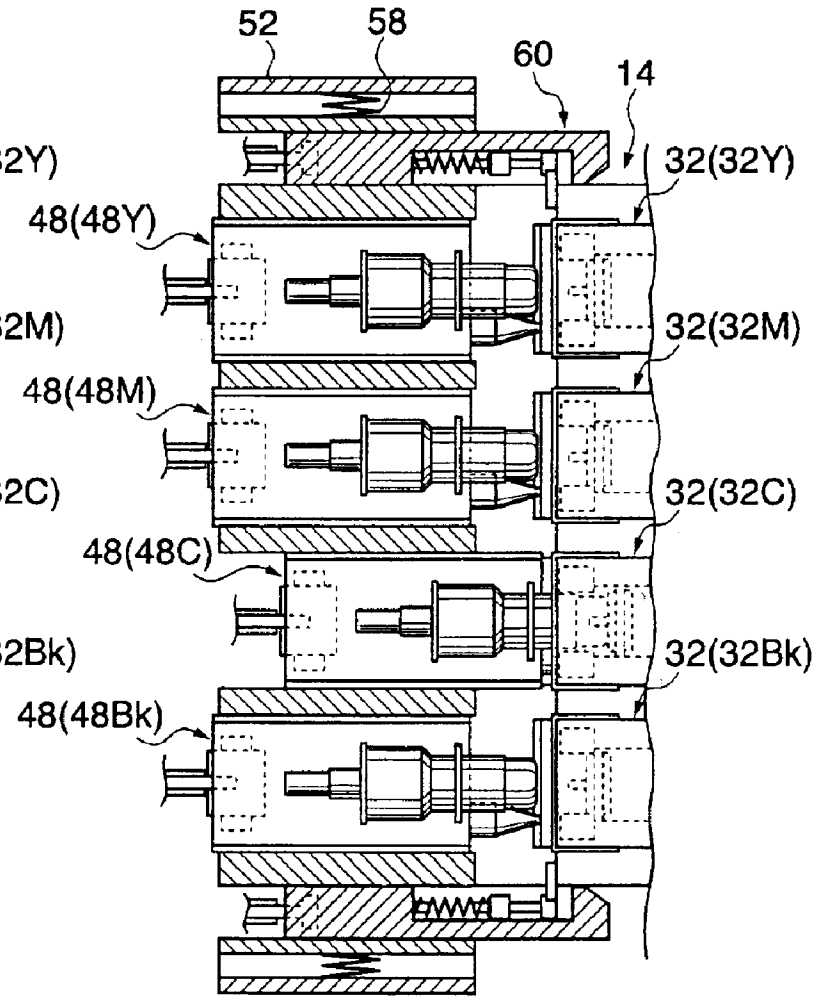
FIG. 15B shows the case of the cyan ink supply unit, in the ink supply device relating to the embodiment of the invention.
Figure 15A:
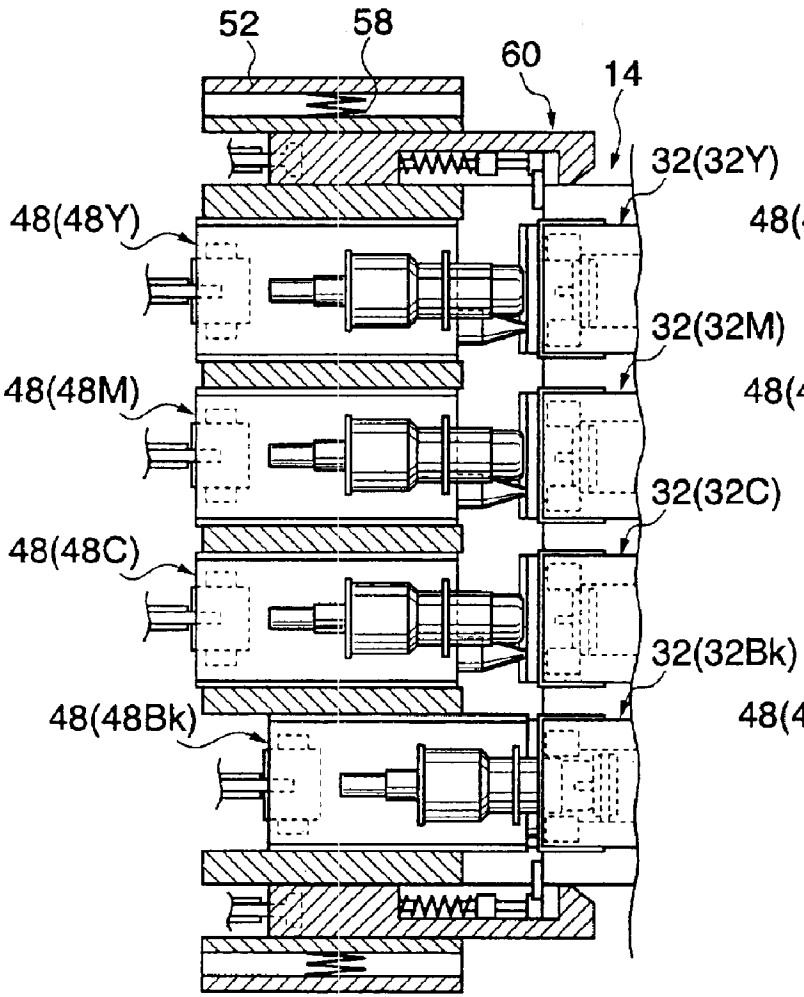
FIG. 15A shows the case of the black ink supply unit.

And, when the rotating angle of the cam unit 144 reaches 40°, the forward cam 146 of the cam unit 144 corresponding to the black ink supply unit 48Bk starts advancing the ink supply unit 48Bk. When the rotating angle reaches 90°, as shown in FIG. 15A, the ink supply unit 48Bk takes the most advanced position, and until the rotating angle reaches 110°, the ink supply unit 48Bk maintains this position (here, stopping or reversing the rotation of the drive motor 128 will not rotate the cam unit 144, accordingly the ink supply unit 48Bk is able to maintain this position, until the drive motor 128 makes the forward rotation next).

Figure 16B:
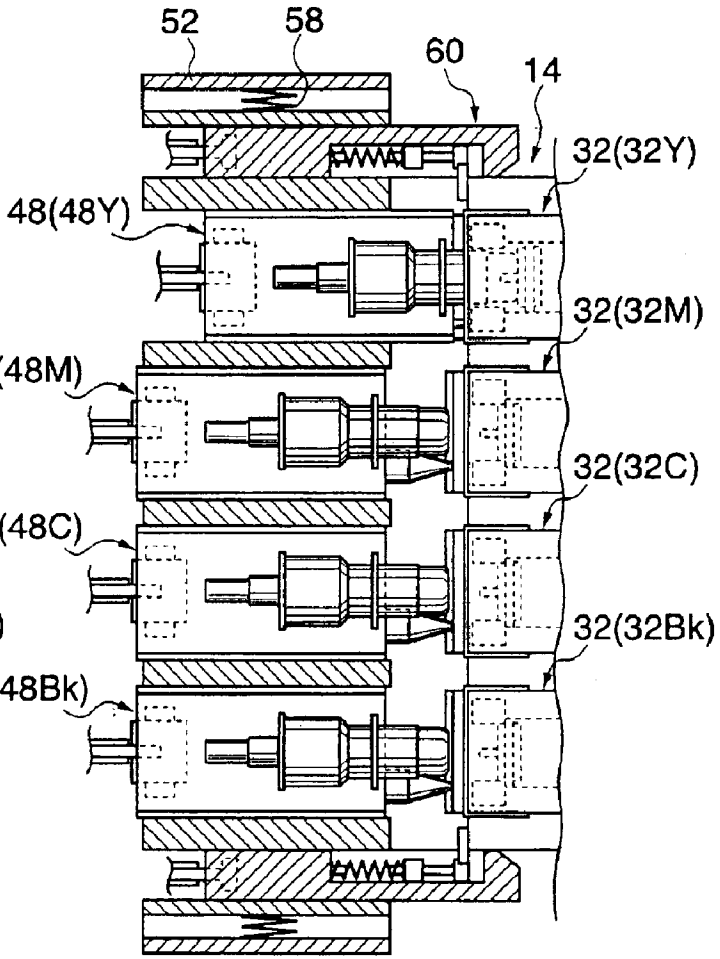
FIG. 16B shows the case of the yellow ink supply unit, in the ink supply device relating to the embodiment of the invention.
Figure 16A:
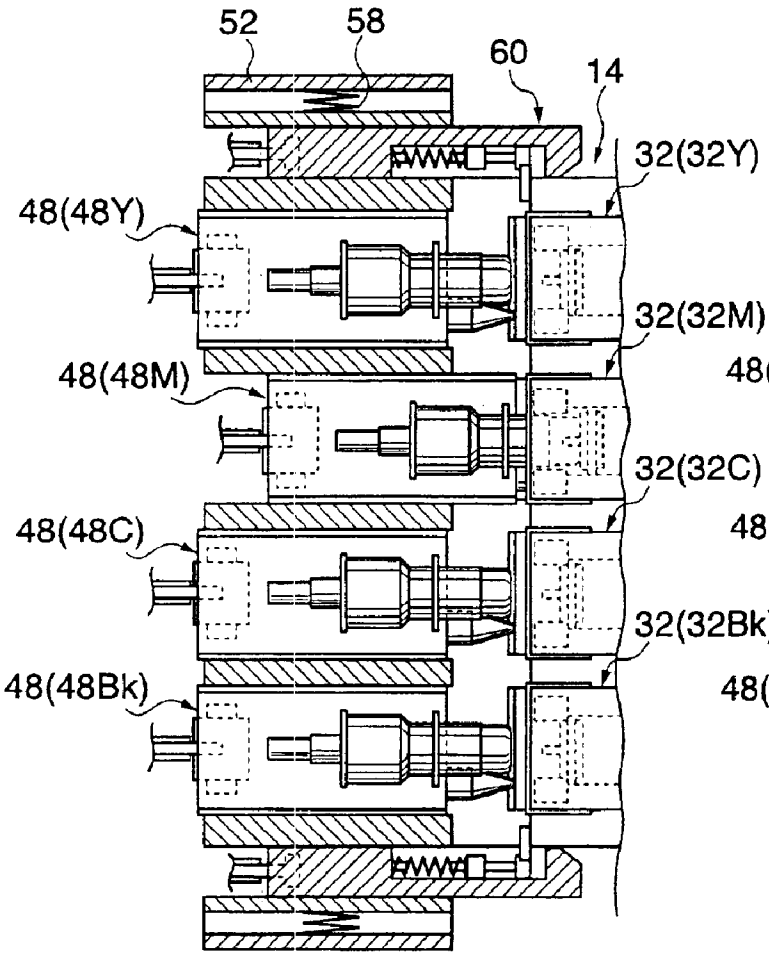
FIG. 16A shows the case of the magenta ink supply unit.

As the cam unit 114 further rotates, the backward cam 148 starts to retreat the ink supply unit 48Bk, and when the rotating angle reaches 140°, the ink supply unit 48Bk retreats to the initial position. And, when the rotating angle reaches 110° (namely, at the same time the ink supply unit 48Bk starts to retreat), the forward cam 146 of the cam unit 144 corresponding to the cyan ink supply unit 48C starts advancing the ink supply unit 48C. When the angle reaches 160°, the ink supply unit 48C takes the most advanced position. Thereafter, when the angle stays between 160° and 180°, the ink supply unit 48C maintains this most advanced position (refer to FIG. 15B); when the angle is at 180°, the backward cam 148 starts to retreat the ink supply unit 48C, and when the angle reaches 210°, the ink supply unit 48C retreats to the initial position. Therefore, the cyan ink supply unit 48C performs the same action with the delay of the rotating angle 70° against the black ink supply unit 48Bk. Thereafter, in the same manner, the magenta ink supply unit 48M performs advance and retreat with the delay of the rotating angle 70° against the cyan ink supply unit 48C (refer to FIG. 16A); and the yellow ink supply unit 48Y performs advance and retreat with the delay of the rotating angle 70° against the magenta ink supply unit 48M (refer to FIG. 16B). In this manner, since the ink supply device 46 of this embodiment provides a specific phase difference (70° in this embodiment) to each of the cam units 144 corresponding to each of the ink supply units 48, it is possible to advance and retreat each of the ink supply units 48 independently with regard to each of the corresponding sub ink tanks 30.

As shown in FIG. 13, as the drive motor 128 makes the reverse rotation, the swing arm 140 being a constituent of the clutch unit 134 swings clockwise, and the output-side gear 142 engages with the pump driving gear train 132; accordingly, the rotating force of the drive motor 128 is transmitted to a pump spindle 166 being a constituent of a pump unit 164.

As shown in FIG. 2, the pump unit 164 has four roller pumps 168 in correspondence with the exhaust tubes 126 extending from the ink supply units 48 each. As shown in FIG. 3, each of the roller pumps 168 has a rotating disc 170 that rotates integrally with the pump spindle 166, and one or plural (two in this embodiment) rollers 172 mounted near the periphery of this rotating disc 170. In contrast to this, the exhaust tube 126 is laid out to partially surround the rotating discs 170, and the roller 172 pushes to crush the exhaust tube 126 locally. Therefore, as the rotating disc 170 rotates clockwise in FIG. 3, the rollers 172 moves to squeeze the exhaust tube 126, and evacuates the fluid (air in this embodiment) inside the exhaust tube 126 into the atmosphere from the other end of the exhaust tube 126. Here, in each of the roller pumps 168, the angle of attaching each of the rotating discs 170 is determined in such a manner that the rollers 172 as a whole are arranged in an equal spacing when viewed from the axial direction of the pump spindle 166. In this embodiment, the pump unit 164 has the four roller pumps 168 installed, and as understood from FIG. 3, the rotating discs 170 each are arranged with a displacement of 45°. Therefore, when viewed along the pump spindle 166, the rollers 172 as a whole are arranged in an equal spacing of the center angle 22.5°. Thereby, the resistance (especially, the rotational resistance resulting from that the roller 172 is pressed by a reaction of the exhaust tube 126) acting on the pump unit 164 is dispersed, and the pump unit 164 rotates smoothly.

The advance and retreat of the ink supply units 48 by the drive (forward rotation or reverse rotation) of the drive motor 128 and the drive of the pump unit 164 are controlled by a control circuit not illustrated so as not to overlap in the timing with the maintenance operation by the maintenance station 20.

Next, the function of the ink supply device 46 and the ink-jet recording device 12 of this embodiment, and the method of supplying ink by the ink supply device 46 will be described.

Ejecting ink drops in accordance with image information from the recording head 28, the recording head carriage 14 moves in the fast-scanning direction, and the recording medium P moves in the slow-scanning direction, whereby images are recorded on the recording medium P. Since the ink supplied from the sub ink tank 30 to the recording head 28 produces the ink drops, the ink inside the sub ink tank 30 decreases, accompanied with the image recording.

As the recording head 28 reaches a specific state that requires any maintenance, the control circuit not illustrated shifts the recording head carriage 14 to the home position, brings the maintenance station 20 close to the recording head 28, and makes the maintenance station 20 carry out a specific maintenance operation. Thereby, the recording head 28 recovers the optimum state for ink ejection, and as a consequence, the optimum state for ink ejection is maintained constantly, which achieves a high picture quality recording on the recording medium P.

As the ink sensor 40 detects that the ink quantity inside a specific sub ink tank 30 has decreased to a specific quantity, and sends the information detected to the control circuit not illustrated, the control circuit shifts the recording head carriage 14 to the ink supply position. At this moment, the control circuit controls the maintenance station 20 not to operate.

Next, the control circuit controls the drive motor 128 to make the forward rotation in such a manner that the cam unit 144 rotates by the angle corresponding to the specific sub ink tank 30. For example, in the case of supplying a black ink into the sub ink tank 30Bk, as understood from FIG. 14, the control circuit controls the drive motor 128 to make the forward rotation in such a manner that the cam unit 144 comes to the rotating angle between 90° or larger and 110° or smaller.

At that moment, first, as the rotating angle of the cam unit 144 reaches 10°, a pair of the positioning arms 60 start advancing; and if the recording head carriage 14 is displaced in the cross direction to the guide frame 54, any one of the tapered faces 62 of the positioning arms 60 comes in contact with a corner of the recording head carriage frame 26. And in this state, as the positioning arms 60 further approach toward the recording head carriage 14, the movement in this approaching direction is converted into a cross-directional movement of the guide frame 54; accordingly, the guide frame 54 moves in the cross direction against the elastic force of the compression coil spring 58. As the positioning arms 60 further approach toward the recording head carriage 14, as shown in FIG. 5, the sides 26S of the recording head carriage frame 26 come in contact with the inner sides 60A of the positioning arms 60, and the recording head carriage 14 and the guide frame 54 are positioned correctly in the cross direction. For example, if the stop position (ink supply position) of the recording head carriage 14 is slightly dislocated, or if there is such a dislocation due to other various factors, this dislocation will be dissolved, and the four ink supply units 48 will integrally be positioned to the corresponding sub ink tanks 30.

As the positioning arms 60 further move forward and the pressing pieces 66 come in contact with the recording head carriage frame 26, the recording head carriage 14 is pressed by receiving the energizing force of the compression coil springs 68. Thereby, the recording head carriage 14 is held between the pressing pieces 66 and the guide members 18, which prevents unexpected plays and/or rattling sounds of the recording head carriage 14.

Here, the rotating angle of the cam unit 144 comes to 40°, which is understood from FIG. 14, and since the forward cam follower 152 is pressed to the sub ink tank 30 in the approaching direction by the forward cam 146 of the cam unit 144 corresponding to the black, the ink supply unit 48Bk advances and starts approaching to the sub ink tank 30Bk. During the advancement (in the state that the positioning pin 78 is not in the positioning port 80), the guide pin 88 moves inside the retaining portion 90A, and the ink supply unit 48 slides in the container 70 of the guide frame 54 without plays.

Figure 7:
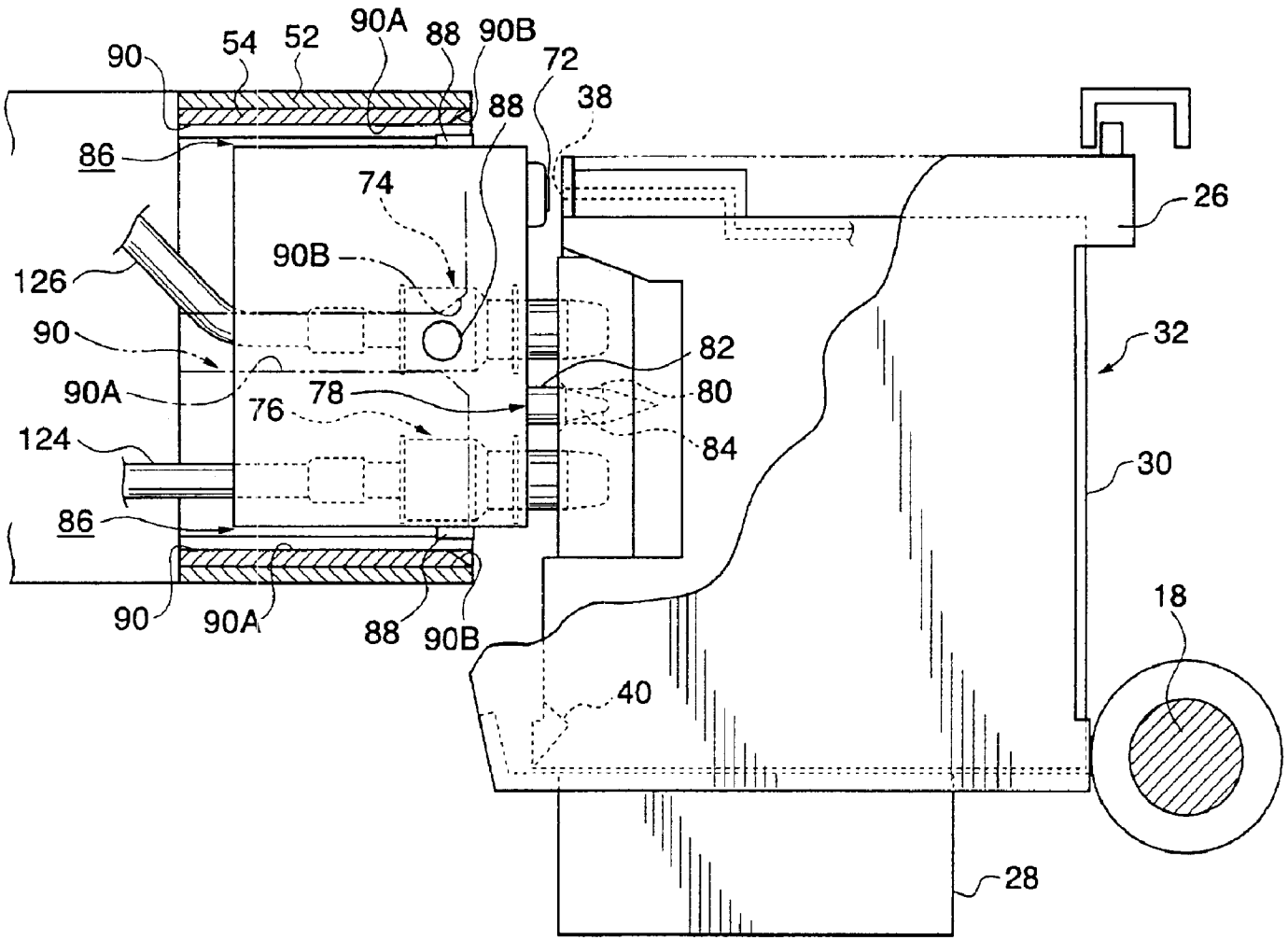
FIG. 7 is a partially broken-out plan view enlarged, illustrating an ink supply unit of the ink supply device and a sub ink tank of the ink-jet recording device with the ink supply unit on the way of advance, relating to the embodiment of the invention.

As shown in FIG. 7, the approaching of the ink supply unit 48 to the sub ink tank 30 starts inserting the positioning pin 78 into the positioning port 80. Here, as understood from FIG. 17, in the state before insertion, the packing 104 seals the communication hole 96 in the pipe body 94 (refer to FIG. 10A), and the inside of the pipe body 94 is sealed. In the same manner, in the inside of the ink supply inlet 44, the valve 118 adheres onto the projection 114C of the gasket 114, which blocks communication with the atmosphere.

Since the guide portion 84 of the positioning pin 78 is tapered toward the front thereof, when the positioning pin 78 is inserted into the positioning port 80, even if the center of the positioning pin 78 is dislocated from the center of the positioning port 80, the positioning pin 78 is driven to enter the positioning port 80. At this moment, the guide pin 88 has reached the divergent portion 90B, and since a gap is formed between the guide pin 88 and the divergent portion 90B, the ink supply unit 48 becomes movable within a certain range in the vertical and cross directions in the container 70. As the ink supply unit 48 further approaches the sub ink tank 30, the guide portion 84 drives the positioning pin 78 and the positioning port 80 to gradually move in such a direction that the centers of both coincide. And, when the positioning portion 82 reaches the positioning port 80, the center of the positioning pin 78 coincides with that of the positioning port 80, whereby a specific ink supply unit 48 and the corresponding sub ink tank 30 are positioned with precision.

Figure 17:
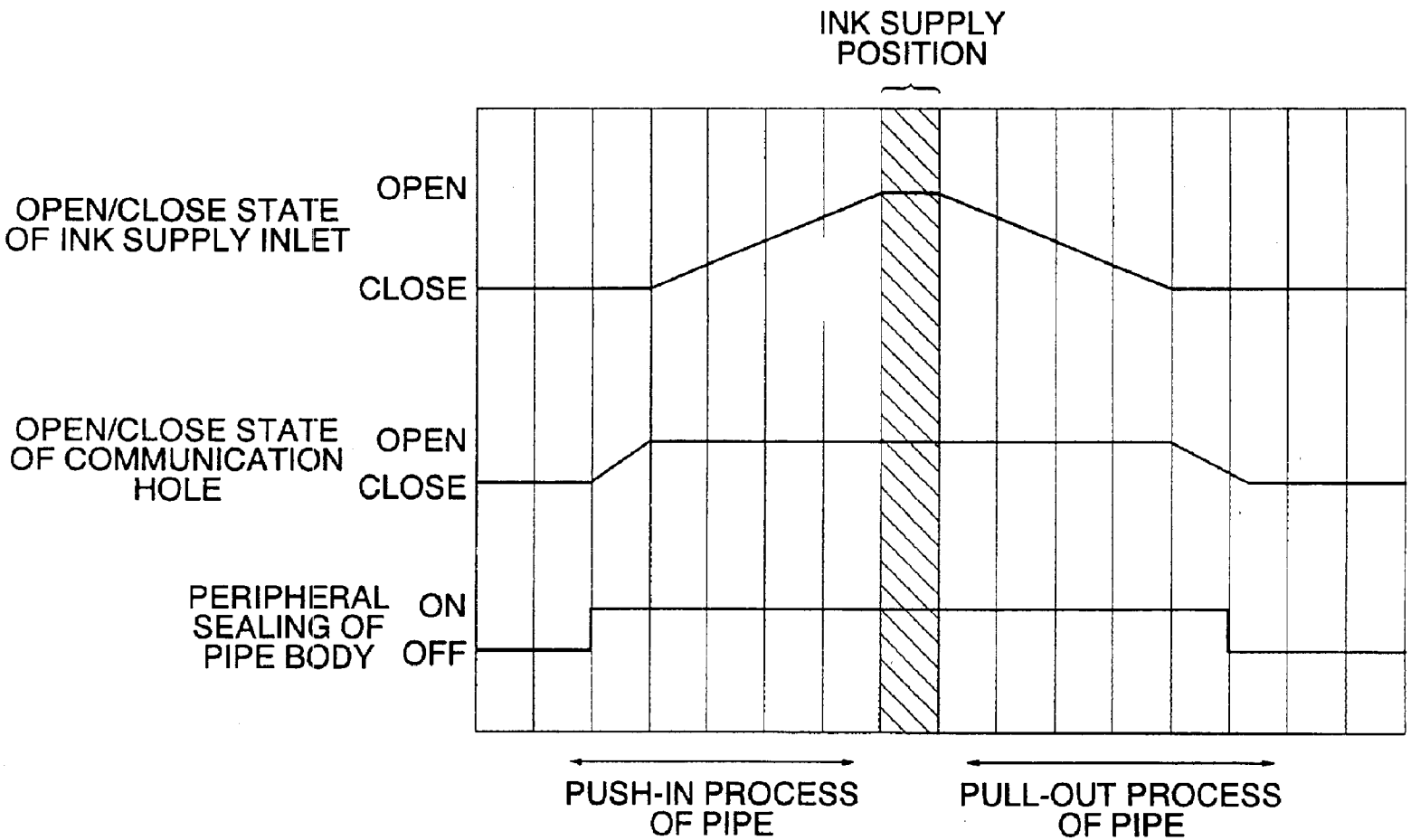
FIG. 17 is a timing chart illustrating a connection state of the ink supply port of the ink supply device and the ink supply inlet of the sub ink tank relating to the embodiment of the invention.
Figure 18:
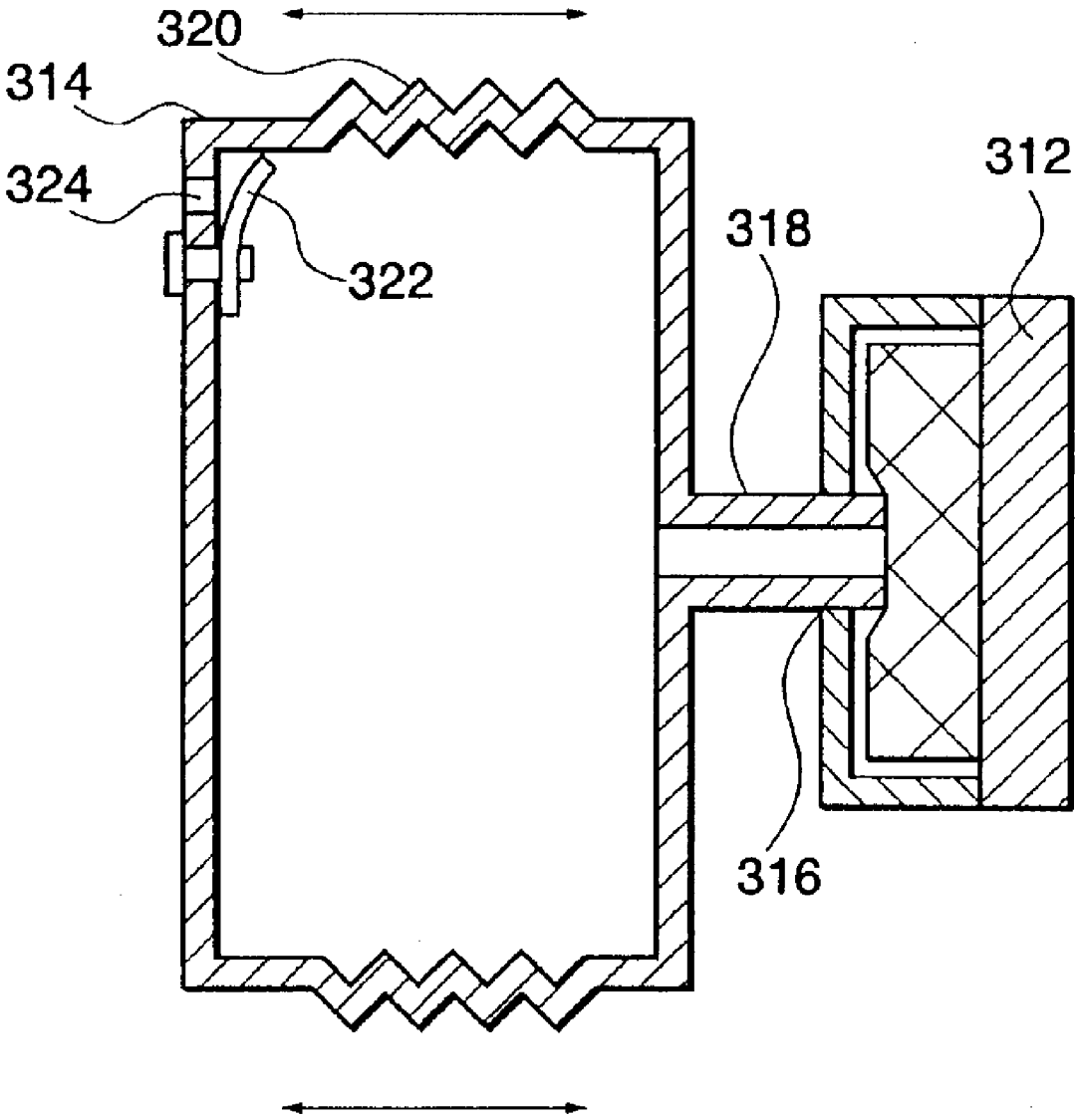
FIG. 18 PRIOR ART
FIG. 18 is a partial sectional view of a conventional ink supply device.
Figure 19:
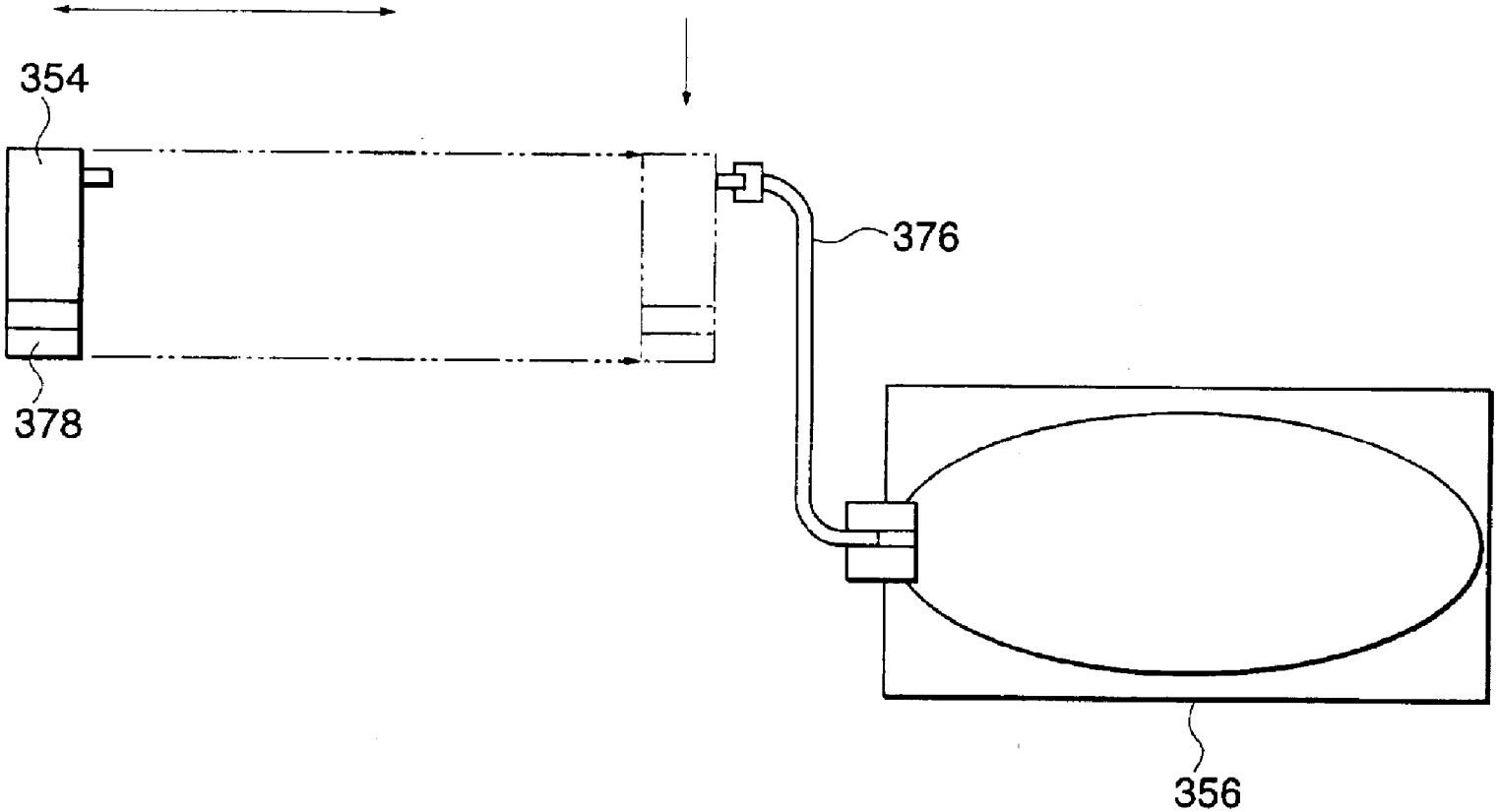
FIG. 19 PRIOR ART
FIG. 19 is an explanatory chart illustrating a schematic construction of the conventional ink supply device.
Figure 20:
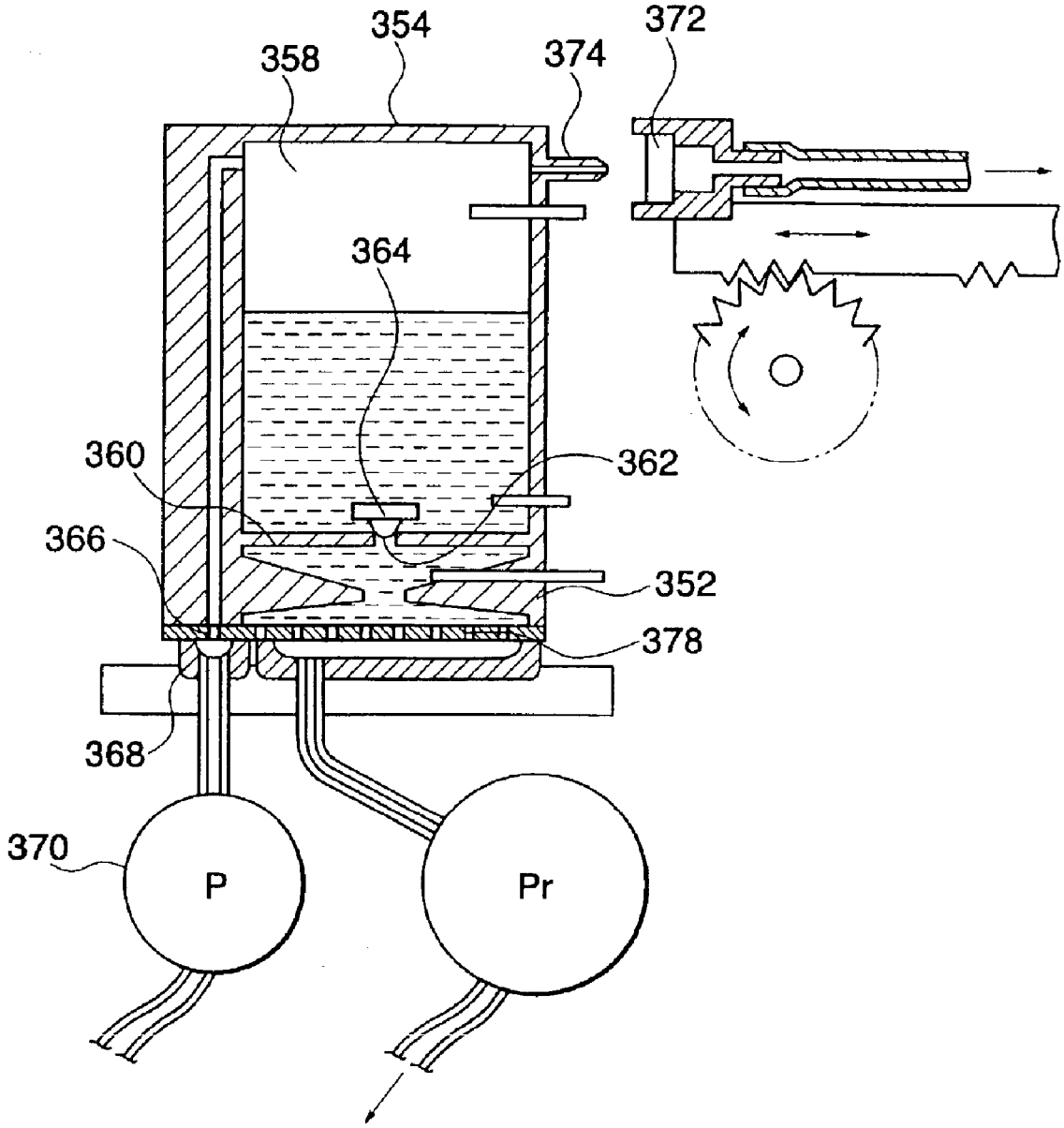
FIG. 20 PRIOR ART
FIG. 20 is a partial sectional view of the conventional ink supply device illustrated in FIG. 19.

Next, as understood from FIG. 10B, FIG. 10C, and FIG. 17, the ink supply port 36 advances, the front of the pipe body 94 enters the ink supply inlet 44 (start of pipe-insertion process), and the front of the valve contact 110 comes into contact with that of the valve protrusion 122. Here, as the pipe body 94 is further pushed in, the valve contact 110 and the valve protrusion 122 press each other. Since the spring constant of the compression coil spring 108 inside the pipe body 94 is set smaller than that of the compression coil spring 120 inside the ink supply inlet 44, first-while the compression coil spring 108 is shrinking, the pipe body 94 only advances (the valve element 98 stands still in strict sense), and the valve element 98 opens the communication hole 96. At this moment, the lip 114B comes into close contact with the circumference of the pipe body 94 to seal the gap between them.

As shown in FIG. 10C, as the pipe body 94 further goes into the ink supply inlet 44, the front of the pipe body 94 comes into contact with the valve 118; accordingly, the compression coil spring 120, being pressed by the pipe body 94 through the valve 118, starts shrinking (the valve element 98 and the pipe body 94, maintaining a relatively virtually constant positional relation, integrally enter the ink supply inlet 44). Thereby, the valve 118 comes off from the projection 114C of the gasket 114, and the spacing between them starts expanding.

Figure 8:
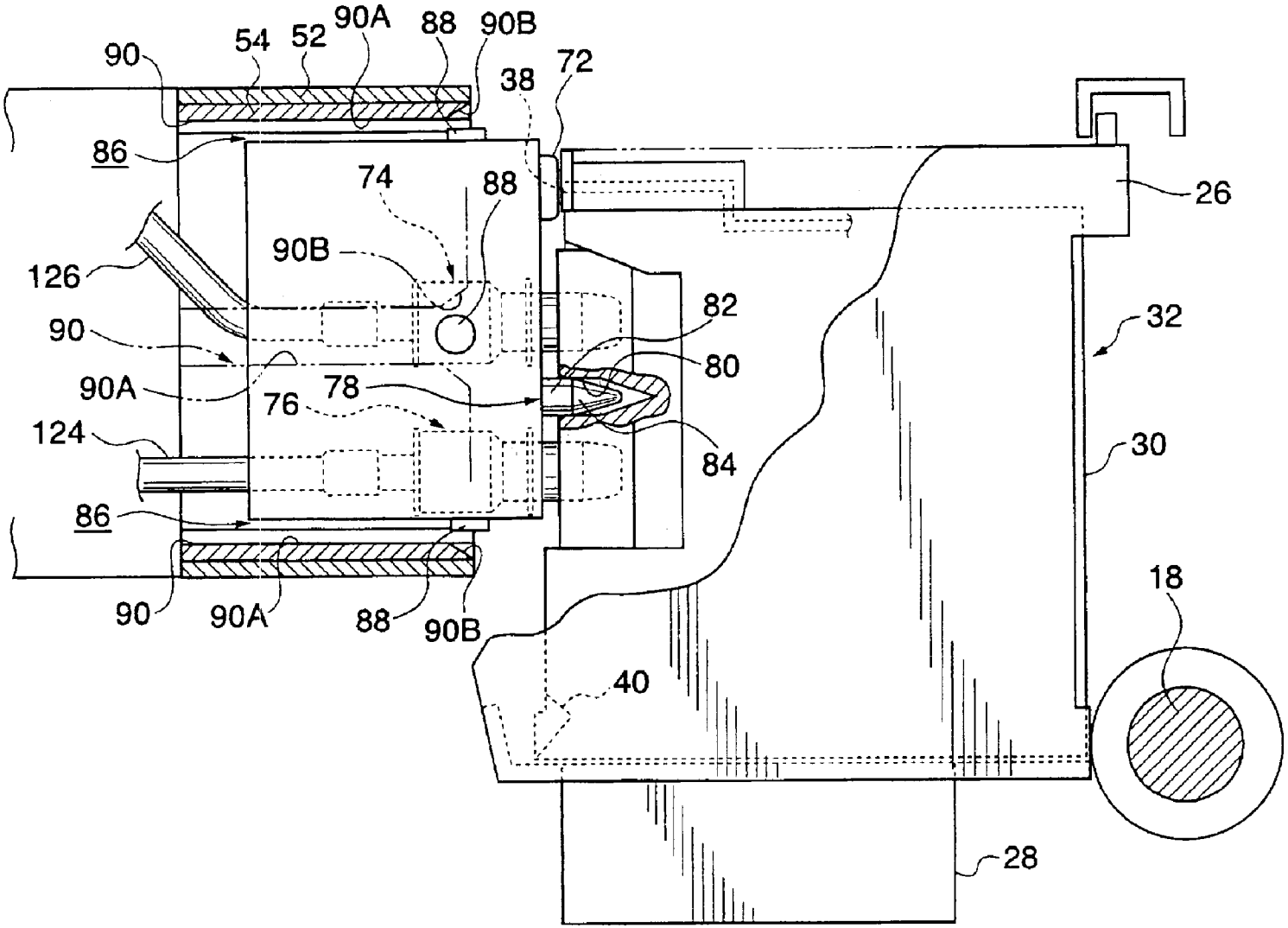
FIG. 8 is a partially broken-out plan view enlarged, illustrating an ink supply unit of the ink supply device and a sub ink tank of the ink-jet recording device with the ink supply unit reaching a ink supply position, relating to the embodiment of the invention.

As shown in FIG. 10D, in the state that the pipe body 94 goes into the innermost, the ink supply unit 48 comes to the ink supply position, the ink supply port 76 and the ink supply inlet 44 of the sub ink tank 30 is completely connected into a liquid coupling, and the flow passage of ink is formed from the main ink tank 50 to the sub ink tank 30Bk. At the same time, the connection of the exhaust port 34 and the air outlet 42 is completed. Thereafter, as shown in FIG. 8, the cap 72 seals the air communication hole 38, which blocks communication of air between the inside and the outside of the sub ink tank 30 (end of pipe-insertion process). Therefore, to control the drive motor 128 into the forward rotation and to bring the cam unit 144 into a specific rotating angle makes it possible to connect a specific ink supply unit 48 to the corresponding sub ink tank 30.

Here, the control circuit not illustrated brings the drive motor 128 into the reverse rotation. The swing arm 140 of the clutch unit 134 swings clockwise in FIG. 12, and as shown in FIG. 13, the transmission of a rotating force by the drive motor 128 is switched from the ink supply unit shifting gear train 130 into the pump driving gear train 132. Thereby, while the position of the ink supply unit 48Bk is being maintained at the ink supply position, the roller pump 168 being a constituent of the pump unit 164 is driven, and the internal air is ejected through the air outlet 42 of the sub ink tank 30Bk by the ink supply unit 48Bk. At this moment, since the air communication hole 38 of the sub ink tank 30Bk is sealed by the cap 72, the air will not come into the sub ink tank 30Bk unexpectedly from the air communication hole 38, and the air can securely be evacuated from the inside of the sub ink tank 30Bk. Also, the corresponding roller pump 168 is to be driven with respect to the ink supply unit 48 that has not advanced to the ink supply position; however, since the exhaust port 74 is opened, the roller pump 168 will not produce a resistance in the driving.

Since the control circuit brings the drive motor 128 into the reverse rotation for a specific time, a specific quantity of ink is supplied into the sub ink tank 30. The time for the reverse rotation of the drive motor 128 may be speculated as a preset constant time, or the time for the reverse rotation may be determined by the feedback control on the basis of ink quantity information from the ink sensor 40.

Next, the control circuit brings the drive motor 128 into the forward rotation. The swing link 160 swings counterclockwise in FIG. 13, and as shown in FIG. 12, the rotating force by the drive motor 128 is transmitted again to the ink supply unit shifting gear train 130, and the cam unit 144 rotates accordingly. As understood from FIG. 14, when the rotating angle of the cam unit 144 reaches 110°, the ink supply unit 48Bk starts to retreat, and the cap 72 comes off from the air communication hole 38, which releases the sub ink tank to the atmospheric pressure.

Further, as understood from FIG. 17, since the pipe body 94 starts to retreat from the ink supply inlet 44 (start of pipe-pulling out process), the valve 118 slides by an elastic force of the compression coil spring 120, and approaches to the projection 114C of the gasket 114. And, as the valve 118 returns to the initial position and adheres onto the projection 114C, the valve element 98 inside the pipe body 94 receives an elastic force of the compression coil spring 108 to slide, and the valve element 98 advances toward the communication hole 96. Further, the circumference of the pipe body 94 comes off from the lip 114B during this movement, and the sealing by these is released accordingly. Thus, the valve element 98 returns to the initial position to seal the communication hole 96, and the pipe body 94 is pulled out from the ink supply inlet 44 (end of pipe-pulling out process).

As the drive motor 128 further makes the forward rotation and the rotating angle of the cam unit 144 comes to 140°, the ink supply unit 48Bk comes to the end point of retreat, and the ink supply unit 48Bk returns to the initial position.

As mentioned above, the black ink supply into the sub ink tank 30Bk is completed, and if another color ink supply to another sub ink tank 30 is needed, the control circuit controls to rotate the drive motor 128 further forward, so that the rotating angle of the cam unit 144 comes to the angle corresponding to the sub ink tank 30 required for the ink supply. If the cyan ink is supplied to the cyan sub ink tank 30C, for example, the drive motor 128 is made to continue the forward rotation until the rotating angle of the cam unit 144 comes to 160° or more to 180° or less, and as shown in FIG. 15B, the cyan ink supply unit 48C is set to the ink supply position. In this state, the control is made to bring the drive motor 128 into the reverse rotation, to drive the roller pump 168, and to supply the ink into the sub ink tank 30C. After the supply of a specified quantity of ink, the control circuit brings the drive motor 128 into the forward rotation, makes the ink supply unit 48C retreat to the initial position. If the ink supply into the sub ink tank 30C is not necessary, the control of the drive motor 128 not making the reverse rotation effects the advance and retreat of the ink supply unit 48C only, and it does not drive the pump unit 164, which precludes the ink supply into the sub ink tank 30C.

Thus, as the ink supply into a desired sub ink tank 30 is completed, as understood from FIG. 14, in the end (strictly speaking, simultaneously with the retreat operation of the ink supply unit 48Y), the cam for retreat corresponding to the positioning arm 60 brings the positioning arm 60 in retreat, and returns it to the initial position. With the aforementioned, all the operations of the ink supply into the sub ink tank 30 are completed.

As understood from the above explanation, this embodiment moves the ink supply unit 48 that requires ink supply, corresponding to a specific sub ink tank 30 among plural sub ink tanks 30, selectively to the ink supply position, and achieves the ink supply into the sub ink tank 30 for each color.

Further, the sub ink tank unit 30 is provided with the air communication hole 38, which softens a surge pressure variation inside the sub ink tank 30. Since this softening prevents an unexpected ink leakage from an ink discharge opening of the recording head 28 and an suction of air, and so forth, the recording head unit 32 is able to maintain an optimum state for discharge of ink.

Further, the ink supply into the sub ink tank 30 is achieved by a negative pressurization inside the sub ink tank 30, and accordingly the inner pressure in the sub ink tank 30 does not rise. Therefore, it is possible to reliably supply a certain quantity of ink into the sub ink tank 30, in a shorter time without an unnecessary application of load, which is advantageous. Also, the ink supply unit 48 itself can be configured very simply, which achieves a cost reduction.

Since the cap 72 seals the air communication hole 38 during the ink supply, when the roller pump 168 is driven and the air inside the sub ink tank 30 is ejected out, the air will not come into the sub ink tank 30 from the air communication hole 38, which enables secure pressure reduction inside the sub ink tank 30, and secure ink supply.

Especially, in this embodiment, the air outlet 42 and the ink supply inlet 44 of the sub ink tank 30 are each connected to the exhaust port 74 and the ink supply port 76 of the ink supply unit 48, respectively; and thereafter, the air communication hole 38 is to be sealed, and in addition the air communication hole 38 is opened, and thereafter the exhaust port 74 and the ink supply port 76 come off the air outlet 42 and the ink supply inlet 44. This construction resolves a pressure variation created inside the sub ink tank 30, accompanied with the connection or disconnection (connection release) operation of the exhaust port 34 and the ink supply port 36.

The sealing part to seal the air communication hole 38 during the ink supply is not necessarily confined to the cap 72, and any other measure may be used as long as it can seal the air communication hole 38. Further, the cap 72 is not necessarily required to be attached to the ink supply unit 48. For example, a holding member to hold the cap 72 may be provided; however, this embodiment attaches the cap 72 to the ink supply unit 48, thereby saves such a holding member, reduces the number of components, and lowers the production cost. Further, the displacement (advance and retreat) of the ink supply unit 48 is utilized for sealing the air communication hole 38 or for releasing the sealing, which saves a device to move the cap 72 and simplifies the construction.

The ink supply device of the invention includes: an ink supply unit provided in correspondence with a recording head unit including a recording head that ejects ink drops onto a recording medium on the basis of image information, and a sub ink tank provided with an air communication hole, storing the ink supplied the recording head, which implements an ink supply by a pressure reduction part reducing a pressure inside the sub ink tank; and a sealing part that at least implements sealing of the air communication hole, while the ink supply unit is reducing the pressure inside the sub ink tank. Therefore, when the ink supply member is in reducing the pressure inside the sub ink tank, the air communication hole of the sub ink tank can be sealed, and the ink supply can be performed securely in a short time.

The entire disclosure of Japanese Patent Application No. 2000-316974 filed on Oct. 17, 2000 including specification, claims, drawings and abstract is incorporated herein by reference in its entirety.

What is claimed is:

1. An ink-jet recording device comprising:

a main housing;

a recording head unit for ejecting ink drops onto a recording medium on the basis of image information, the recording head unit mounted to the main housing and reciprocating in a fast scan direction relative to the main housing;

an ink supply unit for supplying an ink to the recording head unit;

a fixed frame rigidly mounted to the main housing;

a guide frame within which the ink supply unit is mounted, the guide frame movably disposed within the fixed frame such that the guide frame is self-centering in the fast scan direction relative to the fixed frame.

2. An ink-jet recording device of claim 1 comprising:

the recording head unit including a recording head that ejects the ink drops and a sub ink tank;

the ink supply unit being provided with an air suction member and an ink supply member for connecting to the sub ink tank; and a positioning member disposed between the air suction member and the ink supply member on the ink supply unit, wherein the positioning member contacts the sub ink tank to align the, air suction member and the ink supply member to the sub ink tank for connection thereto.

3. The ink-jet recording device of claim 2 wherein the positioning member is substantially vertically aligned with the air suction member and the ink supply member.

4. The ink-jet recording device of claim 2 comprising;

the positioning member being a tapered pin extending outwardly from the ink supply unit toward the sub ink tank; and a positioning port disposed on the sub ink tank for receiving the tapered pin therein when the air suction member and an ink supply member are connected to the sub ink tank.

5. The ink-jet recording device of claim 2 comprising;

a tapered pin extending outwardly from the sub ink tank toward the ink supply unit; and the positioning member being a positioning port for receiving the tapered pin therein when the air suction member and an ink supply member are connected to the sub ink tank.

6. The ink-jet recording device of claim 1 comprising:

a recording head carriage frame in which the recording head unit is mounted;

a pair of positioning arms installed near opposing ends of the guide frame and extending in the direction of the recording head carriage frame;

wherein, when the recording head unit approaches an ink supply position, the guide frame approaches the recording head carriage frame such that the positioning arms contact the recording head carriage frame to urge the ink supply unit into alignment with the recording head unit.

7. The ink-jet recording device of claim 6:

wherein a distance between the positioning arms is substantially equal to the breadth of the recording head carriage frame; and the positioning arms each include a tapered face which contacts corners of the recording head carriage frame to urge the guide frame into alignment when approaching the ink supply position.

8. The ink-jet recording device of claim 1 comprising:

a pair of compression members disposed between the opposing ends of the fixed frame and guide frame, wherein the compression members retain the guide frame substantially in the center of the fixed frame in the fast scan direction.

9. The ink-jet recording device of claim 8 wherein the compression members comprise coil springs.

10. The ink-jet recording device of claim 1 comprising:

the recording head unit including a recording head that ejects the ink drops and a sub ink tank provided with an air communication hole;

the ink supply unit supplying the ink to the sub ink tank soley by reducing a pressure of the inside of the sub ink tank through a pressure reduction part, the ink supply unit being provided with an air suction member and an ink supply member for connecting to the sub ink tank; and a sealing part that at least implements sealing of the air communication hole while the ink supply unit is reducing the pressure inside the sub ink tank.

11. The ink-jet recording device of claim 10 wherein the sealing part is made to seal the air communication hole, after the air suction member and the ink supply member are connected to the sub ink tank.

12. An ink-jet recording device comprising:

a recording head unit including a recording head that ejects ink drops onto a recording medium on the basis of image information and a sub ink tank;

an ink supply unit that supplies an ink to the sub ink tank, the ink supply unit being provided with an air suction member and an ink supply member that are connected to the sub ink tank;

a positioning member that contacts the sub ink tank to align the air suction member and the ink supply member to the sub ink tank during connection thereto.

13. The ink-jet recording device of claim 12 wherein the positioning member is substantially vertically aligned with the air suction member and the ink supply member.

14. The ink-jet recording device of claim 12 comprising;

the positioning member being a tapered pin extending outwardly from the ink supply unit toward the sub ink tank; and a positioning port disposed on the sub ink tank for receiving the tapered pin therein when the air suction member and an ink supply member are connected to the sub ink tank.

15. The ink-jet recording device of claim 12 comprising;

a tapered pin extending outwardly from the sub ink tank toward the ink supply unit; and the positioning member being a positioning port for receiving the tapered pin therein when the air suction member and an ink supply member are connected to the sub ink tank.

16. The ink-jet recording device of claim 12 comprising:

the sub ink tank provided with an air communication hole;

the ink supply unit supplying the ink to the sub ink tank solely by reducing a pressure of the inside of the sub ink tank through a pressure reduction part; and a sealing part that at least implements sealing of the air communication hole while the ink supply unit is reducing the pressure inside the sub ink tank.

17. The ink-jet recording device of claim 16 wherein the sealing part is made to seal the air communication hole, after the air suction member and the ink supply member are connected to the sub ink tank.

18. The ink-jet recording device of claim 12 comprising:

an ink sensor disposed within the sub ink tank for detecting a level of ink in the sub-ink tank, wherein the ink sensor is located between the ink supply member and the recording head when the ink supply member is connected to the sub ink tank.

19. The ink-jet recording device of claim 12 wherein the positioning member is disposed between the air suction member and the ink supply member on the ink supply unit.

* * * * *